US007831434B2

(12) United States Patent
Mehrotra et al.

(10) Patent No.: US 7,831,434 B2
(45) Date of Patent: Nov. 9, 2010

(54) COMPLEX-TRANSFORM CHANNEL CODING WITH EXTENDED-BAND FREQUENCY CODING

(75) Inventors: Sanjeev Mehrotra, Kirkland, WA (US); Wei-Ge Chen, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 1188 days.

(21) Appl. No.: 11/336,606

(22) Filed: Jan. 20, 2006

(65) Prior Publication Data

US 2007/0174062 A1 Jul. 26, 2007

(51) Int. Cl.
*G10L 19/00* (2006.01)
*H04R 5/00* (2006.01)

(52) U.S. Cl. ..... 704/500; 704/501; 381/21; 381/23

(58) Field of Classification Search ..... 704/500–502; 381/22–23

See application file for complete search history.

(56) References Cited

U.S. PATENT DOCUMENTS

| | | | |
|---|---|---|---|
| 4,251,688 | A | 2/1981 | Furner |
| 5,079,547 | A | 1/1992 | Fuchigama et al. |
| 5,260,980 | A | 11/1993 | Akagiri et al. |
| 5,388,181 | A | 2/1995 | Anderson et al. |
| 5,455,888 | A | 10/1995 | Iyengar et al. |
| 5,473,727 | A | 12/1995 | Nishiguchi et al. |
| 5,524,054 | A | 6/1996 | Spille |
| 5,539,829 | A | 7/1996 | Lokhoff et al. |
| 5,581,653 | A | 12/1996 | Todd |
| 5,627,938 | A | 5/1997 | Johnston |
| 5,629,780 | A | 5/1997 | Watson |
| 5,632,003 | A | 5/1997 | Davidson et al. |
| 5,636,324 | A | 6/1997 | Teh et al. |
| 5,661,755 | A | 8/1997 | Van De Kerkhof et al. |
| 5,661,823 | A | 8/1997 | Yamauchi et al. |
| 5,682,152 | A | 10/1997 | Wang et al. |

(Continued)

FOREIGN PATENT DOCUMENTS

| | | |
|---|---|---|
| EP | 0597649 | 5/1994 |

(Continued)

OTHER PUBLICATIONS

J. Breebaart, et al., "Parametric Coding of Stereo Audio", EURASIP Jour. Applied Signal Proc., Sep. 2005, pp. 1305- 1322.*

(Continued)

*Primary Examiner*—James S Wozniak
(74) *Attorney, Agent, or Firm*—Klarquist Sparkman, LLP

(57) ABSTRACT

An audio encoder receives multi-channel audio data comprising a group of plural source channels and performs channel extension coding, which comprises encoding a combined channel for the group and determining plural parameters for representing individual source channels of the group as modified versions of the encoded combined channel. The encoder also performs frequency extension coding. The frequency extension coding can comprise, for example, partitioning frequency bands in the multi-channel audio data into a baseband group and an extended band group, and coding audio coefficients in the extended band group based on audio coefficients in the baseband group. The encoder also can perform other kinds of transforms. An audio decoder performs corresponding decoding and/or additional processing tasks, such as a forward complex transform.

22 Claims, 21 Drawing Sheets

U.S. PATENT DOCUMENTS 5,686,964 A 11/1997 Tabatabai et al.
5,701,346 A 12/1997 Herre et al.
5,745,275 A 4/1998 Giles et al.
5,812,971 A 9/1998 Herre
5,822,370 A 10/1998 Graupe
5,835,030 A 11/1998 Tsutsui et al.
5,845,243 A 12/1998 Smart
5,956,674 A 9/1999 Smyth et al.
5,960,390 A 9/1999 Ueno et al.
5,974,380 A 10/1999 Smyth et al.
5,995,151 A 11/1999 Naveen et al.
6,029,126 A 2/2000 Malvar
6,041,295 A 3/2000 Hinderks
6,058,362 A 5/2000 Malvar
6,064,954 A 5/2000 Cohen et al.
6,104,321 A 8/2000 Akagiri
6,115,688 A 9/2000 Brandenburg et al.
6,115,689 A 9/2000 Malvar
6,182,034 B1 1/2001 Malvar
6,205,430 B1 3/2001 Hui
6,226,616 B1 5/2001 You
6,240,380 B1 5/2001 Malvar
6,249,614 B1 6/2001 Kolesnik et al.
6,341,165 B1 1/2002 Gbur et al.
6,353,807 B1 3/2002 Tsutsui et al.
6,370,128 B1 4/2002 Raitola
6,393,392 B1 5/2002 Minde
6,418,405 B1 7/2002 Satyamurti et al.
6,434,190 B1 8/2002 Modlin
6,445,739 B1 9/2002 Shen et al.
6,473,561 B1 10/2002 Heo
6,499,010 B1 12/2002 Faller
6,658,162 B1 12/2003 Zeng et al.
6,680,972 B1 1/2004 Liljeryd
6,697,491 B1 2/2004 Griesinger
6,704,711 B2 * 3/2004 Gustafsson et al. ..... 704/258
6,738,074 B2 5/2004 Rao et al.
6,760,698 B2 7/2004 Gao
6,766,293 B1 7/2004 Herre
6,771,777 B1 8/2004 Gbur et al.
6,774,820 B2 8/2004 Craven et al.
6,836,761 B1 12/2004 Kawashima et al.
6,934,677 B2 8/2005 Chen et al.
6,940,840 B2 9/2005 Ozluturk et al.
7,027,982 B2 4/2006 Chen et al.
7,050,972 B2 5/2006 Henn et al.
7,058,571 B2 * 6/2006 Tsushima et al. ..... 704/225
7,062,445 B2 6/2006 Kadatch
7,069,212 B2 * 6/2006 Tanaka et al. ..... 704/225
7,096,240 B1 8/2006 Absar et al.
7,240,001 B2 7/2007 Chen et al.
7,299,190 B2 11/2007 Thumpudi et al.
7,328,162 B2 * 2/2008 Liljeryd et al. ..... 704/503
7,386,132 B2 6/2008 Griesinger
7,394,903 B2 * 7/2008 Herre et al. ..... 381/23
7,502,743 B2 3/2009 Thumpudi et al.
7,519,538 B2 * 4/2009 Villemoes et al. ..... 704/501
7,602,922 B2 * 10/2009 Breebaart et al. ..... 381/23
2003/0009327 A1 1/2003 Nilsson et al.
2003/0050786 A1 3/2003 Jax et al.
2003/0115041 A1 6/2003 Chen et al.
2003/0115042 A1 6/2003 Chen et al.
2003/0115051 A1 6/2003 Chen et al.
2003/0115052 A1 6/2003 Chen et al.
2003/0236580 A1 12/2003 Wilson et al.
2004/0044527 A1 3/2004 Thumpudi et al.
2004/0049379 A1 3/2004 Thumpudi et al.
2004/0078194 A1 4/2004 Liljeryd et al.
2004/0267543 A1 * 12/2004 Ojanpera ..... 704/500
2005/0065780 A1 3/2005 Wiser et al.
2005/0165611 A1 7/2005 Mehrotra et al.
2005/0246164 A1 11/2005 Ojala et al.
2005/0267763 A1 * 12/2005 Ojanpera ..... 704/500
2006/0013405 A1 * 1/2006 Oh et al. ..... 381/23
2006/0106619 A1 5/2006 Iser et al.
2006/0259303 A1 11/2006 Bakis
2007/0081536 A1 * 4/2007 Kim et al. ..... 370/392
2007/0112559 A1 * 5/2007 Schuijers et al. ..... 704/203
2007/0140499 A1 6/2007 Davis
2007/0172071 A1 7/2007 Mehrotra et al.

FOREIGN PATENT DOCUMENTS

EP 0663740 7/1995
EP 0669724 8/1995
EP 0910927 4/1999
EP 0 924 962 6/1999
EP 0931386 7/1999
EP 1175030 1/2002
EP 1408484 4/2004
EP 1617418 1/2006
WO WO 99/43110 8/1999
WO WO 02/43054 5/2002
WO WO 2005098821 A2 * 10/2005

OTHER PUBLICATIONS

Autti, et al, "Mobile Audio—from MP3 to Aac and further," Helsinki University of Technology, Nov. 2004, pp. 1-20.*
Schuijers, et al, "Low Complexity Parametric Stereo Coding," 116th convention of the AES, May 2004, pp. 1-11.*
"Audio Codec Processing function; Extended AMR Wideband codec; Transcoding Functions", 3rd Generation Partnership Technical Specification, Sep. 2004, pp. 1-86.*
Breebaart et al. "MPEG spatial audio coding/MPEG Surround: Overview and current status," in Proc. 119th AES Conv., New York, Oct. 2005, pp. 1-17.*
Herre et al. "The Reference Model Architecture for MPEG Spatial Audio Coding," Proc. 118th AES convention, Barcelona, Spain, May 2005, pp. 1-13.*
Malvar. "A modulated complex lapped transform and its applications to audio processing." in Proc. IEEE Int. Conf. on Acoustics, Speech, and Signal Processing, Pheonix, 1999, pp. 1-9.*
Bier, "Digital Audio Compression: Why, What, and How," © 2000-2002 Berkeley Design Technology, Inc., Dec. 2, 2002, 15 pages.
Brandenburg, "MP3 and AAC Explained," AES 17th International Conference on High Quality Audio Coding, 1999, 12 pages.
Gibson et al., Digital Compression for Multimedia, Title Page, Contents, "Chapter 8: Frequency Domain Speech and Audio Coding Standards," Morgan Kaufman Publishers, Inc., pp. 263-290 (1998).
Gillespie et al., "Speech dereverberation via maximum-kurtosis subband adaptive filtering," Proc. IEEE ICASSP, 2001, pp. 3701-3704.
Herre, "From Joint Stereo to Spatial Audio Coding—Recent Progress and Standardization," Proc. of the 7th Int. Conference on Digital Audio Effects (DAFx'04), 2004, pp. 157-162.
Herre et al., "Intensity Stereo Coding," presented at AES 96th Convention, 1994, 11 pages.
Püschel et al., "The Algebraic Approach to the Discrete Cosine and Sine Transforms and their Fast Algorithms," SIAM Journal of Computing 2003, vol. 32, No. 5, pp. 1280-1316.
"Radio Engineering," authored by KPRi-Services, Inc., printed from internet on Dec. 13, 2005, 3 pages.
Schroeder, "'Colorless' Artificial Reverberation," presented at Audio Engineering Society 12th Annual Meeting, 1960, 18 pages.
Schroeder, "Natural Sounding Artificial Reverberation," presented at the Audio Engineering Society 13th Annual Meeting, 1961, 18 pages.
"Smart Project—Algebraic Theorgy of Signal Processing," http://www.ece.cmu.edu/~smart/papers/dttaglo.html, printed from internet on Jun. 30, 2006, 2 pages.
Smith, "Physical Audio Signal Processing: for Virtual Musical Instruments and Digital Audio Effects," (Global Contents—13 pages, Allpass Filters—2 pages, Schroeder Allpass Sections—2 pages, and A Schroeder Reverberator called JCRev—2 pages) of online book at http://ccrrna.stanford.edu/~jos/pasp/, Center for Computer Research in Music and Acoustics (CCRMA), Stanford University, printed from internet on Dec. 20, 2005, 19 pages.
Yang et al., "Adaptive Karhunen-Loeve Transform for Enhanced Multichannel Audio Coding," Proc. SPIE vol. 4475, 12 pp., Mathematics of Data/Image Coding, Compression, and Encryption IV, with Applications, Mark S. Schmalz, Editor, Dec. 2001, pp. 43-54.
Advanced Television Systems Committee, ATSC Standard: Digital Audio Compression (AC-3), Revision A, 140 pp. (1995).
Beerends, "Audio Quality Determination Based on Perceptual Measurement Techniques," Applications of Digital Signal Processing to Audio and Acoustics, Chapter 1, Ed. Mark Kahrs, Karlheinz Brandenburg, Kluwer Acad. Publ., pp. 1-38 (1998).
Bosi et al., "ISO/IEC MPEG-2 Advanced Audio Coding," Journal of the Audio Engineering Society, Audio Engineering Society, vol. 45, No. 10, pp. 789-812 (1997).
Brandenburg, "ASPEC CODING", AES 10th International Conference, pp. 81-90 (1991).
Caetano et al., "Rate Control Strategy for Embedded Wavelet Video Coders," Electronics Letters, pp. 1815-1817 (Oct. 14, 1999).
Davis, "The AC-3 Multichannel Coder," Dolby Laboratories, 9 pp. (Downloaded from the World Wide Web on Aug. 15, 2002).
De Luca, "AN1090 Application Note: STA013 MPEG 2.5 Layer III Source Decoder," STMicroelectronics, 17 pp. (1999).
de Queiroz et al., "Time-Varying Lapped Transforms and Wavelet Packets," IEEE Transactions on Signal Processing, vol. 41, pp. 3293-3305 (1993).
Dolby Laboratories, "AAC Technology," 4 pp. [Downloaded from the web site aac-audio.com on World Wide Web on Nov. 21, 2001.].
Edler et al., "Perceptual Audio Coding Using a Time-Varying Linear Pre- and Post-Filter," in AES 109th Convention, Los Angeles, California, 12 pp. (Sep. 2000).
Fraunhofer-Gesellschaft, "MPEG Audio Layer-3," 4 pp. [Downloaded from the World Wide Web on Oct. 24, 2001.].
Fraunhofer-Gesellschaft, "MPEG-2 AAC," 3 pp. [Downloaded from the World Wide Web on Oct. 24, 2001.].
Gibson et al., Digital Compression for Multimedia, Title Page, Contents, "Chapter 7: Frequency Domain Coding," Morgan Kaufman Publishers, Inc., pp. iii, v-xi, and 227-262 (1998).
Mark Hasegawa-Johnson and Abeer Alwan, "Speech coding: fundamentals and applications," Handbook of Telecommunications, John Wiley and Sons, Inc., pp. 1-33 (2003). [available at http://citeseer.ist.psu.edu/617093.html].
Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
"ISO/IEC 11172-3, Information Technology—Coding of Moving Pictures and Associated Audio for Digital Storage Media at Up to About 1.5 Mbit/s—Part 3: Audio," 154 pp. (1993).
ISO/IEC 13818-7, Information technology—Generic coding of moving pictures and associated audio information—Part 7: Advanced Audio Coding (AAC), 150 pp. (1997).
"ISO/IEC 13818-7, Information Technology—Generic Coding of Moving Pictures and Associated Audio Information—Part 7: Advanced Audio Coding (AAC)," 174 pp. (1997).
"ISO/IEC 13818-7, Information Technology—Generic Coding of Moving Pictures and Associated Audio Information—Part 7: Advanced Audio Coding (AAC), Technical Corrigendum 1," 22 pp. (1998).
ITU, Recommendation ITU-R BS 1115, Low Bit-Rate Audio Coding, 9 pp. (1994).
ITU, Recommendation ITU-R BS 1387, Method for Objective Measurements of Perceived Audio Quality, 89 pp. (1998).
Jesteadt et al., "Forward Masking as a Function of Frequency, Masker Level, and Signal Delay," Journal of Acoustical Society of America, 71:950-962 (1982).
A.M. Kondoz, Digital Speech: Coding for Low Bit Rate Communications Systems, "Chapter 3.3: Linear Predictive Modeling of Speech Signals" and "Chapter 4: LPC Parameter Quantisation Using LSFs," John Wiley & Sons, pp. 42-53 and 79-97 (1994).
Kuo et al., "A Study of Why Cross Channel Prediction is Not Applicable to Perceptual Audio Coding," IEEE Signal Processing Letters, vol. 8, No. 9, 3 pp. (Sep. 2001).
Laaksonen, "Bandwidth extension in high-quality audio coding," Master's Thesis, 69 pp., May 30, 2005.
Lufti, "Additivity of Simultaneous Masking," Journal of Acoustic Society of America, 73:262-267 (1983).
Malvar, "Biorthogonal and Nonuniform Lapped Transforms for Transform Coding with Reduced Blocking and Ringing Artifacts," appeared in IEEE Transactions on Signal Processing, Special Issue on Multirate Systems, Filter Banks, Wavelets, and Applications, vol. 46, 29 pp. (1998).
H.S. Malvar, "Lapped Transforms for Efficient Transform/Subband Coding," IEEE Transactions on Acoustics, Speech and Signal Processing, vol. 38, No. 6, pp. 969-978 (1990).
H.S. Malvar, *Signal Processing with Lapped Transforms*, Artech House, Norwood, MA, pp. iv, vii-xi, 175-218, 353-57 (1992).
Meares, D.J., "Matrixed Surround Sound in an MPEG Digital World," Journal of the Audio Engineering Society, vol. 46, No. 4, 13 pp. (Apr. 1998).
"Method for Objective Measurements of Perceived Audio Quality", Rec. ITU-R BS.1387 (Question ITU-R 210/10) 1998.
"MPEG2 Audio for DVD:The Compromise Choice," 5 pp. (Oct. 1996).
Najafzadeh-Azghandi, Hossein and Kabal, Peter, "Perceptual coding of narrowband audio signals at 8 Kbit/s" (1997), available at http://citeseer.ist.psu.edu/najafzadeh-azghandi97perceptual.html.
OPTICOM GmbH, "Objective Perceptual Measurement," 14 pp. [Downloaded from the World Wide Web on Oct. 24, 2001.].
Painter, T. And Spanias, A., "Perceptual Coding of Digital Audio," Proceedings of the IEEE, vol. 88, Issue 4, pp. 451-515, Apr. 2000, available at http://www.eas.asu.edu/~spanias/papers/paper-audio-tedspanias-00.pdf.
Phamdo, "Speech Compression," 13 pp. [Downloaded from the World Wide Web on Nov. 25, 2001.].
Ribas Corbera et al., "Rate Control in DCT Video Coding for Low-Delay Communications," IEEE Transactions on Circuits and Systems for Video Technology, vol. 9, No. 1, pp. 172-185 (Feb. 1999).
Seymour Schlien, "The Modulated Lapped Transform, Its Time-Varying Forms, and Its Application to Audio Coding Standards," IEEE Transactions on Speech and Audio Processing, vol. 5, No. 4, pp. 359-366 (Jul. 1997).
M. Schroeder, B. Atal, "Code-excited linear prediction (CELP): High-quality speech at very low bit rates," Proc. IEEE Int. Conf ASSP, pp. 937-940, 1985.
Schulz, D., "Improving audio codecs by noise substitution," Journal of the AES, vol. 44, No. 7/8, pp. 593-598, Jul./Aug. 1996.
Search Report from PCT/US2004/024935.
Search Report for European Patent Application No. 03 020 110.7.
Search Report for European Patent Application No. 03 020 111.5.
Solari, Digital Video and Audio Compression, Title Page, Contents, "Chapter 8: Sound and Audio," McGraw-Hill, Inc., pp. iii, v-vi, and 187-211 (1997).
Th. Sporer, Kh. Brandenburg, B. Edler, "The Use of Multirate Filter Banks for Coding of High Quality Digital Audio," 6th European Signal Processing Conference (EUSIPCO), Amsterdam, vol. 1, pp. 211-214, Jun. 1992.
Srinivasan et al., "High-Quality Audio Compression Using an Adaptive Wavelet Packet Decomposition and Psychoacoustic Modeling," IEEE Transactions on Signal Processing, vol. 46, No. 4, pp. 1085-1093 (Apr. 1998).
Stuart et al., "Lossless Compression for DVD-Audio," in AES 9th Regional Convention Tokyo, 4 pp. (1999).
Terhardt, "Calculating Virtual Pitch," Hearing Research, 1:155-182 (1979).
Vaidyanathan, Multirate Systems and Filter Banks, Prentice Hall Signal Processing Series, Cover page, pp. 745-751 (1992).
Van Assche et al., "Lossless Compression of Pre-Press Image Using a Novel Color Decorrelation Technique," Proc. SPIE, Very High Resolution and Quality III. vol. 3308, 8 pp. (1998).
Wang et al., "A Multichannel Audio Coding Algorithm for Inter-Channel Redundancy Removal," in AES 110th Convention, Amsterdam, the Netherlands, 6pp. (May 2001).
Wang et al., "EE225a Lecture 13: Karhunen Loève Transform and Discrete Cosine Transform," Department of EECS, University of California at Berkley, 10 pp. (Mar. 2002).

Wragg et al., "An Optimised Software Solution for an ARM PoweredTM MP3 Decoder," 9 pp. [Downloaded from the World Wide Web on Oct. 27, 2001.].
Yang et al., "An Inter-Channel Redundancy Removal Approach for High-Quality Multichannel Audio Compression," in AES 109th Convention, Los Angeles, California, 8 pp. (Sep. 2000).
Zwicker et al., Das Ohr als Nachrichtenempfänger, Title Page, Table of Contents, "I: Schallschwingungen," Index, Hirzel-Verlag, Stuttgart, pp. III, IX-XI, 1-26, and 231-32 (1967).
Zwicker, Psychoakustik, Title Page, Table of Contents, "Teil I: Einfuhrung," Index, Springer-Verlag, Berlin Heidelberg, New York, pp. II, IX-XI, 1-30, and 157-162 (1982).
Dietz et al., "Spectral Band Replication, a novel approach in audio coding," Preprint 5553, 112th AES Convention, Munich, 8 pages, May 2002.
Ekstrand, "Bandwidth Extension of Audio Signals by Spectral Band Replication," Proc 1st EEE Benelux Workshop on Model based Processing and Coding of Audio, Leuven, Belgium, Nov. 2002, pp. 73-79.
Kornagel, "Techniques for artificial bandwidth extension of telephone speech," Signal Processing, vol. 86, No. 6, pp. 1296-1306, Oct. 2005.
Lopez et al., "Software Toolbox for Multichannel Sound Reproduction," Proceedings of Digital Audio Effects Conference (DAFX), Barcelona, Spain, Dec. 1998, 4 pp.
Search Report from PCT/US2007/000021.
Geiger et al., "Audio Coding Based on Integer Transforms," AES Convention Paper 5471, 111th AES Convention, New York, NY, Sep. 21-24, 2001.
Purnhagen, "Low Complexity Parametric Stereo Coding in MPEG-4," Proc. of the 7th Int. Conference on Digital Audio Effects, Oct. 2004, pp. 163-168.
Moriya et al., "Extension and Complexity Reduction of TWINVQ Audio Coder," Proceedings of the 1996 IEEE International Conference on Acoustics, Speech, and Signal Processing, pp. 1029-1032 (May 7-10, 1996).
Soon et al., "Bandwidth Extension of Narrowband Speech Using Soft-decision Vector Quantization," ICICS 2005, pp. 734-738.
Wright, "Notes on Ogg Vorbis and the MDCT," www.free-comp-shop.com, 7 pp. (May 2003).
Non-final Office Action dated Dec. 18, 2009, U.S. Appl. No. 11/336,403, 7 pages.

* cited by examiner

Figure 13

$$\begin{bmatrix} C_0 \\ C_1 \end{bmatrix} \alpha \begin{bmatrix} C_0^* & C_1^* \end{bmatrix} = \begin{bmatrix} X_0 X_0^* & X_0 X_1^* \\ X_1 X_0^* & X_1 X_1^* \end{bmatrix}$$

$$C_0 C_0^* \alpha = X_0 X_0^*$$

$$C_1 C_1^* \alpha = X_1^* X_1^*$$

$$\mathrm{Re}(C_0 C_1^* \alpha) = \mathrm{Re}(X_0 X_1^*)$$

Figure 14

$$[C_0 C_0^* + C_1 C_1^* + 2\,\mathrm{Re}(C_0 C_1^*)] = \frac{1}{\beta^2}$$

$$|C_0|^2 + |C_1|^2 + 2|C_0||C_1|\cos(\phi_0 - \phi_1) = \frac{1}{\beta^2}$$

Figure 15

$$|C_0| = \sqrt{\frac{X_0 X_0^*}{\beta^2 (X_0 X_0^* + X_1^* X_1^* + 2\,\mathrm{Re}(X_0 X_1^*))}}$$

$$|C_1| = \sqrt{\frac{X_1 X_1^*}{\beta^2 (X_0 X_0^* + X_1^* X_1^* + 2\,\mathrm{Re}(X_0 X_1^*))}}$$

$$|C_0||C_1|\cos(\phi_0 - \phi_1) = \frac{\mathrm{Re}(X_0 X_1^*)}{\beta^2 (X_0 X_0^* + X_1^* X_1^* + 2\,\mathrm{Re}(X_0 X_1^*))}$$

Figure 16

$$\theta = \phi_0 - \phi_1 = \pm \mathrm{acos}\left( \frac{1 - \beta^2 |C_0|^2 - \beta^2 |C_1|^2}{2\beta^2 |C_0||C_1|} \right)$$

Figure 17

$$\mathrm{angle}[(|C_0| e^{j\phi_0} + |C_1| e^{j\phi_1})(B_0 X_0[l] + B_1 X_1[l])] = \mathrm{angle}(B_0 X_0[l] + B_1 X_1[l])$$

Figure 18

$$\phi_1 = \operatorname{atan}\left(\frac{-|C_0|\sin\theta}{|C_0|\cos\theta + |C_1|}\right)$$

$$\phi_0 = \operatorname{atan}\left(\frac{|C_1|\sin\theta}{|C_0| + |C_1|\cos\theta}\right) = \theta + \phi_1$$

Figure 19

$$|C_0|\cos\phi_0 = \frac{\beta^2|C_0|^2 - \beta^2|C_1|^2 + 1}{2\beta}$$

$$|C_1|\cos\phi_1 = \frac{\beta^2|C_1|^2 - \beta^2|C_0|^2 + 1}{2\beta}$$

Figure 20

$$|C_0|\sin\phi_0 = \sqrt{|C_0|^2 - (|C_0|\cos\phi_0)^2}$$

$$|C_1|\sin\phi_1 = \sqrt{|C_1|^2 - (|C_1|\cos\phi_0)^2}$$

Figure 21

$$\begin{bmatrix} W_0 \\ W_{0F} \\ W_1 \\ W_{1F} \end{bmatrix}$$

Figure 22

$$\begin{bmatrix} S_0 \\ S_1 \end{bmatrix} = \begin{bmatrix} a & b & 0 & 0 \\ 0 & 0 & c & d \end{bmatrix} \begin{bmatrix} W_0 \\ W_{0F} \\ W_1 \\ W_{1F} \end{bmatrix}$$

Figure 23

$$\begin{bmatrix} S_0 \\ S_1 \end{bmatrix} = \begin{bmatrix} aC_0 & bC_0 \\ cC_1 & dC_1 \end{bmatrix} \begin{bmatrix} Z_0 \\ Z_{0F} \end{bmatrix} = \begin{bmatrix} aC_0 & b/a & 0 \\ cC_1 & 0 & d/c \end{bmatrix} \begin{bmatrix} Z_0 \\ W_{0F} \\ W_{1F} \end{bmatrix}$$

Figure 24

$$R_{XX} = \begin{bmatrix} X_0X_0^* & X_0X_1^* \\ X_1X_0^* & X_1X_1^* \end{bmatrix} = U\Lambda U^*$$

Figure 25

$$\frac{R_{XX}}{\alpha} = \begin{bmatrix} |C_0|^2 & |C_0||C_1|\cos\theta + j\,\mathrm{Im}(X_0X_1^*)/\alpha \\ |C_0||C_1|\cos\theta - j\,\mathrm{Im}(X_0X_1^*)/\alpha & |C_1|^2 \end{bmatrix} = U\frac{\Lambda}{\alpha}U^*$$

Figure 26

$$\frac{R_{XX}}{|X_0||X_1|} = \begin{bmatrix} X_0X_0^*/|X_0||X_1| & X_0X_1^*/|X_0||X_1| \\ X_1X_0^*/|X_0||X_1| & X_1X_1^*/|X_0||X_1| \end{bmatrix} = \begin{bmatrix} R_{00} & R_{01} \\ R_{01}^* & 1/R_{00} \end{bmatrix}$$

Figure 27

$$\frac{|X_0||X_1|}{\alpha} = \frac{|X_0||X_1|}{[X_0X_0^* + X_1X_1^* + 2\,\mathrm{Re}(X_0X_1^*)]\beta^2} = \frac{1}{[R_{00} + (1/R_{00}) + 2\,\mathrm{Re}(R_{01})]\beta^2}$$

Figure 28

$$U\left(\frac{\Lambda}{\alpha}\right)^{1/2} V\alpha V^* \left(\frac{\Lambda}{\alpha}\right)^{1/2} U^* = U\Lambda U^*$$

$$U\left(\frac{\Lambda}{\alpha}\right)^{1/2} V = \begin{bmatrix} aC_0 & bC_0 \\ cC_1 & dC_1 \end{bmatrix}$$

Figure 29

$$U\left(\frac{\Lambda}{\alpha}\right)^{1/2}V=\begin{bmatrix}u_{00} & u_{01}\\ u_{10} & u_{11}\end{bmatrix}\begin{bmatrix}\cos\omega & \sin\omega\\ -\sin\omega & \cos\omega\end{bmatrix}=\begin{bmatrix}u_{00}\cos\omega-u_{10}\sin\omega & u_{00}\sin\omega+u_{01}\cos\omega\\ u_{10}\cos\omega-u_{11}\sin\omega & u_{10}\sin\omega+u_{11}\cos\omega\end{bmatrix}$$

Figure 30

$$u_{00}\sin\omega+u_{01}\cos\omega=-(u_{10}\sin\omega+u_{11}\cos\omega)$$
$$\omega=\operatorname{atan2}(-u_{11}-u_{01},u_{00}+u_{10})$$

Figure 31

$$\begin{bmatrix}aC_0 & b/a & 0\\ cC_1 & 0 & d/c\end{bmatrix}$$

Figure 32

$$W_{0F}^{'}=W_{0F}a|C_0|\left(\frac{|Z_0|}{|W_{0F}|}\right),$$
$$|W_{0F}^{'}|=|Z_0|a|C_0|$$

Figure 33

If: $|W_{0F}|\geq|Z_0|a|C_0|*T$ then: $W_{0F}=W_{0F}a|C_0|\left(\frac{|Z_0|}{|W_{0F}|}\right)T$ for some constant $T$.

COMPLEX-TRANSFORM CHANNEL CODING WITH EXTENDED-BAND FREQUENCY CODING

BACKGROUND

Engineers use a variety of techniques to process digital audio efficiently while still maintaining the quality of the digital audio. To understand these techniques, it helps to understand how audio information is represented and processed in a computer.

I. Representation of Audio Information in a Computer

A computer processes audio information as a series of numbers representing the audio information. For example, a single number can represent an audio sample, which is an amplitude value at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values. The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels usually labeled the left and right channels. Other modes with more channels such as 5.1 channel, 7.1 channel, or 9.1 channel surround sound (the "1" indicates a sub-woofer or low-frequency effects channel) are also possible. Table 1 shows several formats of audio with different quality levels, along with corresponding raw bitrate costs.

TABLE 1

Bitrates for different quality audio information

| | Sample Depth (bits/sample) | Sampling Rate (samples/second) | Mode | Raw Bitrate (bits/second) |
|---|---|---|---|---|
| Internet telephony | 8 | 8,000 | mono | 64,000 |
| Telephone | 8 | 11,025 | mono | 88,200 |
| CD audio | 16 | 44,100 | stereo | 1,411,200 |

Surround Sound Audio Typically has Even Higher Raw Bitrate.

As Table 1 shows, the cost of high quality audio information is high bitrate. High quality audio information consumes large amounts of computer storage and transmission capacity. Companies and consumers increasingly depend on computers, however, to create, distribute, and play back high quality audio content.

II. Processing Audio Information in a Computer

Many computers and computer networks lack the resources to process raw digital audio. Compression (also called encoding or coding) decreases the cost of storing and transmitting audio information by converting the information into a lower bitrate form. Decompression (also called decoding) extracts a reconstructed version of the original information from the compressed form. Encoder and decoder systems include certain versions of Microsoft Corporation's Windows Media Audio ("WMA") encoder and decoder and WMA Pro encoder and decoder.

Compression can be lossless (in which quality does not suffer) or lossy (in which quality suffers but bitrate reduction from subsequent lossless compression is more dramatic). For example, lossy compression is used to approximate original audio information, and the approximation is then losslessly compressed. Lossless compression techniques include run-length coding, run-level coding, variable length coding, and arithmetic coding. The corresponding decompression techniques (also called entropy decoding techniques) include run-length decoding, run-level decoding, variable length decoding, and arithmetic decoding.

One goal of audio compression is to digitally represent audio signals to provide maximum perceived signal quality with the least possible amounts of bits. With this goal as a target, various contemporary audio encoding systems make use of a variety of different lossy compression techniques. These lossy compression techniques typically involve perceptual modeling/weighting and quantization after a frequency transform. The corresponding decompression involves inverse quantization, inverse weighting, and inverse frequency transforms.

Frequency transform techniques convert data into a form that makes it easier to separate perceptually important information from perceptually unimportant information. Less important information can then be subjected to more lossy compression, while more important information is preserved, so as to provide the best perceived quality for a given bitrate. A frequency transform typically receives audio samples and converts them from the time domain into data in the frequency domain, sometimes called frequency coefficients or spectral coefficients.

Perceptual modeling involves processing audio data according to a model of the human auditory system to improve the perceived quality of the reconstructed audio signal for a given bitrate. For example, an auditory model typically considers the range of human hearing and critical bands. Using the results of the perceptual modeling, an encoder shapes distortion (e.g., quantization noise) in the audio data with the goal of minimizing the audibility of the distortion for a given bitrate.

Quantization maps ranges of input values to single values, introducing irreversible loss of information but also allowing an encoder to regulate the quality and bitrate of the output. Sometimes, the encoder performs quantization in conjunction with a rate controller that adjusts the quantization to regulate bitrate and/or quality. There are various kinds of quantization, including adaptive and non-adaptive, scalar and vector, uniform and non-uniform. Perceptual weighting can be considered a form of non-uniform quantization. Inverse quantization and inverse weighting reconstruct the weighted, quantized frequency coefficient data to an approximation of the original frequency coefficient data. An inverse frequency transform then converts the reconstructed frequency coefficient data into reconstructed time domain audio samples.

Joint coding of audio channels involves coding information from more than one channel together to reduce bitrate. For example, mid/side coding (also called M/S coding or sum-difference coding) involves performing a matrix operation on left and right stereo channels at an encoder, and sending resulting "mid" and "side" channels (normalized sum and difference channels) to a decoder. The decoder reconstructs the actual physical channels from the "mid" and "side" channels. M/S coding is lossless, allowing perfect reconstruction if no other lossy techniques (e.g., quantization) are used in the encoding process.

Intensity stereo coding is an example of a lossy joint coding technique that can be used at low bitrates. Intensity stereo coding involves summing a left and right channel at an encoder and then scaling information from the sum channel at a decoder during reconstruction of the left and right channels. Typically, intensity stereo coding is performed at higher frequencies where the artifacts introduced by this lossy technique are less noticeable.

Given the importance of compression and decompression to media processing, it is not surprising that compression and decompression are richly developed fields. Whatever the advantages of prior techniques and systems, however, they do not have various advantages of the techniques and systems described herein.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In summary, the detailed description is directed to strategies for encoding and decoding multi-channel audio. For example, an audio encoder uses one or more techniques to improve the quality and/or bitrate of multi-channel audio data. This improves the overall listening experience and makes computer systems a more compelling platform for creating, distributing, and playing back high-quality multi-channel audio. The encoding and decoding strategies described herein include various techniques and tools, which can be used in combination or independently.

For example, an audio encoder receives multi-channel audio data, the multi-channel audio data comprising a group of plural source channels. The encoder performs channel extension coding on the multi-channel audio data. The channel extension coding comprises encoding a combined channel for the group, and determining plural parameters for representing individual source channels of the group as modified versions of the encoded combined channel. The encoder also performs frequency extension coding on the multi-channel audio data. The frequency extension coding can comprise, for example, partitioning frequency bands in the multi-channel audio data into a baseband group and an extended band group, and coding audio coefficients in the extended band group based on audio coefficients in the baseband group.

As another example, an audio decoder receives encoded multi-channel audio data comprising channel extension coding data and frequency extension coding data the decoder reconstructs plural audio channels using the channel extension coding data and the frequency extension coding data. The channel extension coding data comprises a combined channel for the plural audio channels and plural parameters for representing individual channels of the plural audio channels as modified versions of the combined channel.

As another example, an audio decoder receives multi-channel audio data and performs an inverse multi-channel transform, an inverse base time-to-frequency transform, frequency-extension processing and channel-extension processing on the received multi-channel audio data. The decoder can perform decoding that corresponds to encoding performed in an encoder, and/or additional steps such as a forward complex transform on the received data, and can perform the steps in various orders.

For several of the aspects described herein in terms of an audio encoder, an audio decoder performs corresponding processing and decoding.

The foregoing and other objects, features, and advantages will become more apparent from the following detailed description, which proceeds with reference to the accompanying figures.

BRIEF DESCRIPTION OF THE DRAWINGS

FIGS. 13-33 are equations and related matrix arrangements showing details of channel extension processing in some implementations.

DETAILED DESCRIPTION

Various techniques and tools for representing, coding, and decoding audio information are described. These techniques and tools facilitate the creation, distribution, and playback of high quality audio content, even at very low bitrates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding audio information. Many of the techniques and tools described herein for representing, coding, and decoding audio information can also be applied to video information, still image information, or other media information sent in single or multiple channels.

I. Computing Environment

Figure 1:
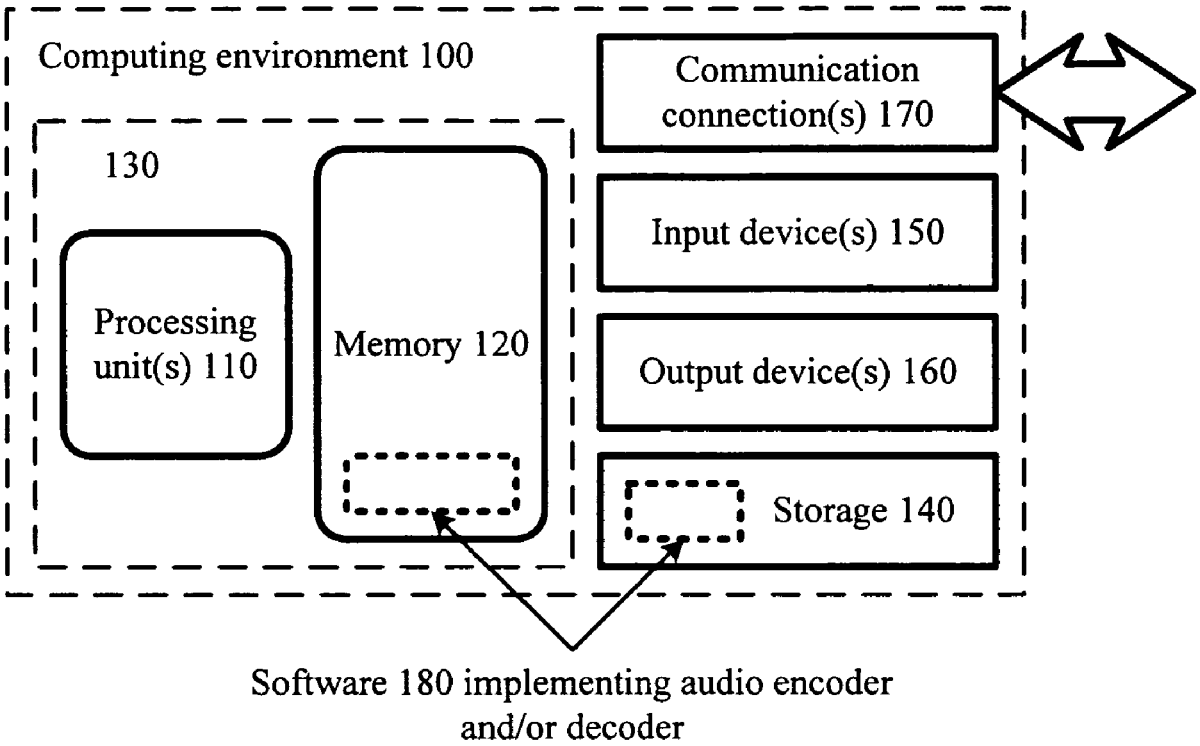
FIG. 1 is a block diagram of a generalized operating environment in conjunction with which various described embodiments may be implemented.

FIG. 1 illustrates a generalized example of a suitable computing environment 100 in which described embodiments may be implemented. The computing environment 100 is not intended to suggest any limitation as to scope of use or functionality, as described embodiments may be implemented in diverse general-purpose or special-purpose computing environments.

With reference to FIG. 1, the computing environment 100 includes at least one processing unit 110 and memory 120. In FIG. 1, this most basic configuration 130 is included within a dashed line. The processing unit 110 executes computer-executable instructions and may be a real or a virtual processor. In a multi-processing system, multiple processing units execute computer-executable instructions to increase processing power. The memory 120 may be volatile memory (e.g., registers, cache, RAM), non-volatile memory (e.g., ROM, EEPROM, flash memory), or some combination of the two. The memory 120 stores software 180 implementing one or more audio processing techniques and/or systems according to one or more of the described embodiments.

A computing environment may have additional features. For example, the computing environment 100 includes storage 140, one or more input devices 150, one or more output devices 160, and one or more communication connections 170. An interconnection mechanism (not shown) such as a bus, controller, or network interconnects the components of the computing environment 100. Typically, operating system software (not shown) provides an operating environment for software executing in the computing environment 100 and coordinates activities of the components of the computing environment 100.

The storage 140 may be removable or non-removable, and includes magnetic disks, magnetic tapes or cassettes, CDs, DVDs, or any other medium which can be used to store information and which can be accessed within the computing environment 100. The storage 140 stores instructions for the software 180.

The input device(s) 150 may be a touch input device such as a keyboard, mouse, pen, touchscreen or trackball, a voice input device, a scanning device, or another device that provides input to the computing environment 100. For audio or video, the input device(s) 150 may be a microphone, sound card, video card, TV tuner card, or similar device that accepts audio or video input in analog or digital form, or a CD or DVD that reads audio or video samples into the computing environment. The output device(s) 160 may be a display, printer, speaker, CD/DVD-writer, network adapter, or another device that provides output from the computing environment 100.

The communication connection(s) 170 enable communication over a communication medium to one or more other computing entities. The communication medium conveys information such as computer-executable instructions, audio or video information, or other data in a data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

Embodiments can be described in the general context of computer-readable media. Computer-readable media are any available media that can be accessed within a computing environment. By way of example, and not limitation, with the computing environment 100, computer-readable media include memory 120, storage 140, communication media, and combinations of any of the above.

Embodiments can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular data types. The functionality of the program modules may be combined or split between program modules as desired in various embodiments. Computer-executable instructions for program modules may be executed within a local or distributed computing environment.

For the sake of presentation, the detailed description uses terms like "determine," "receive," and "perform" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
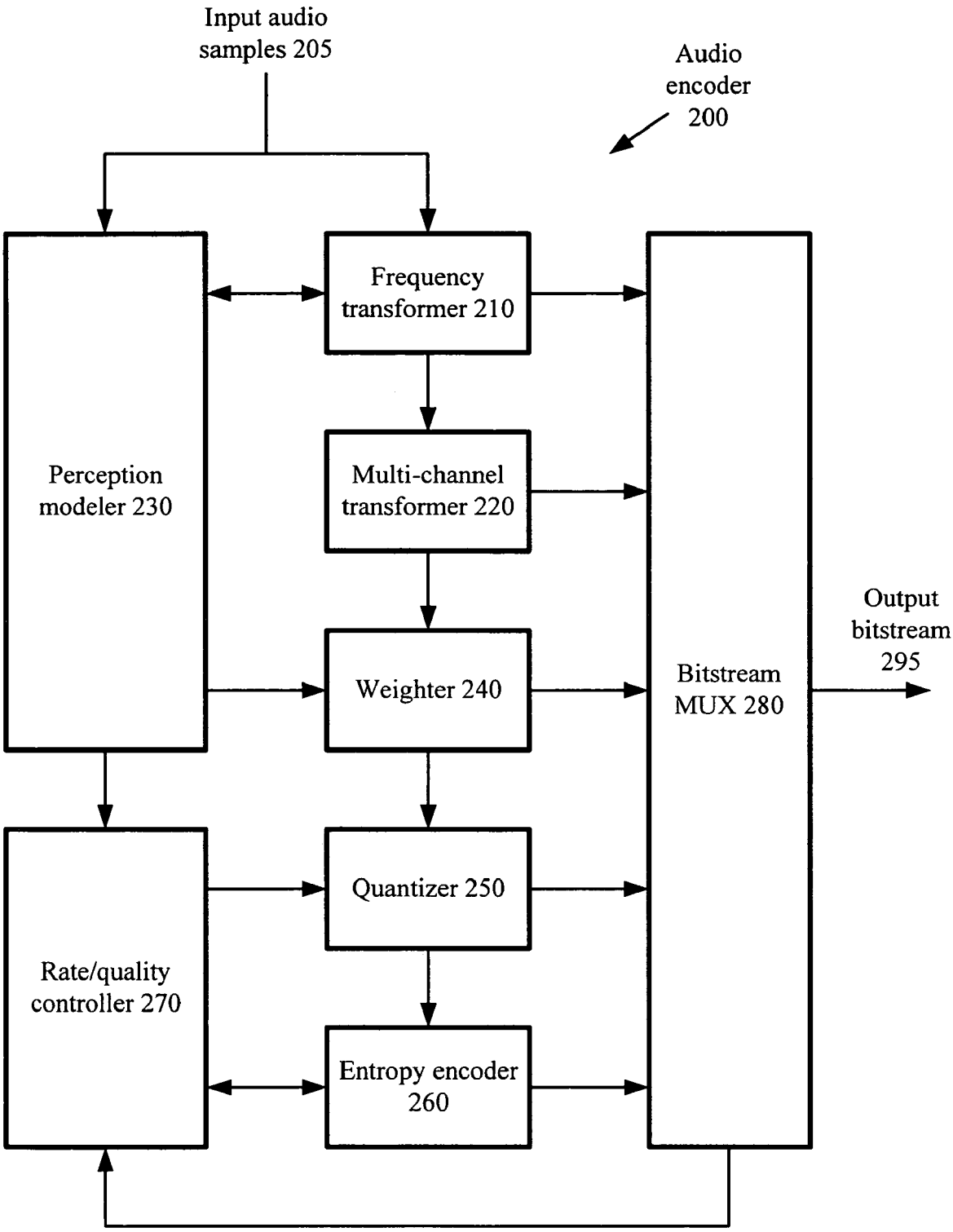
FIGS. 2, 3, 4, and 5 are block diagrams of generalized encoders and/or decoders in conjunction with which various described embodiments may be implemented.
Figure 3:
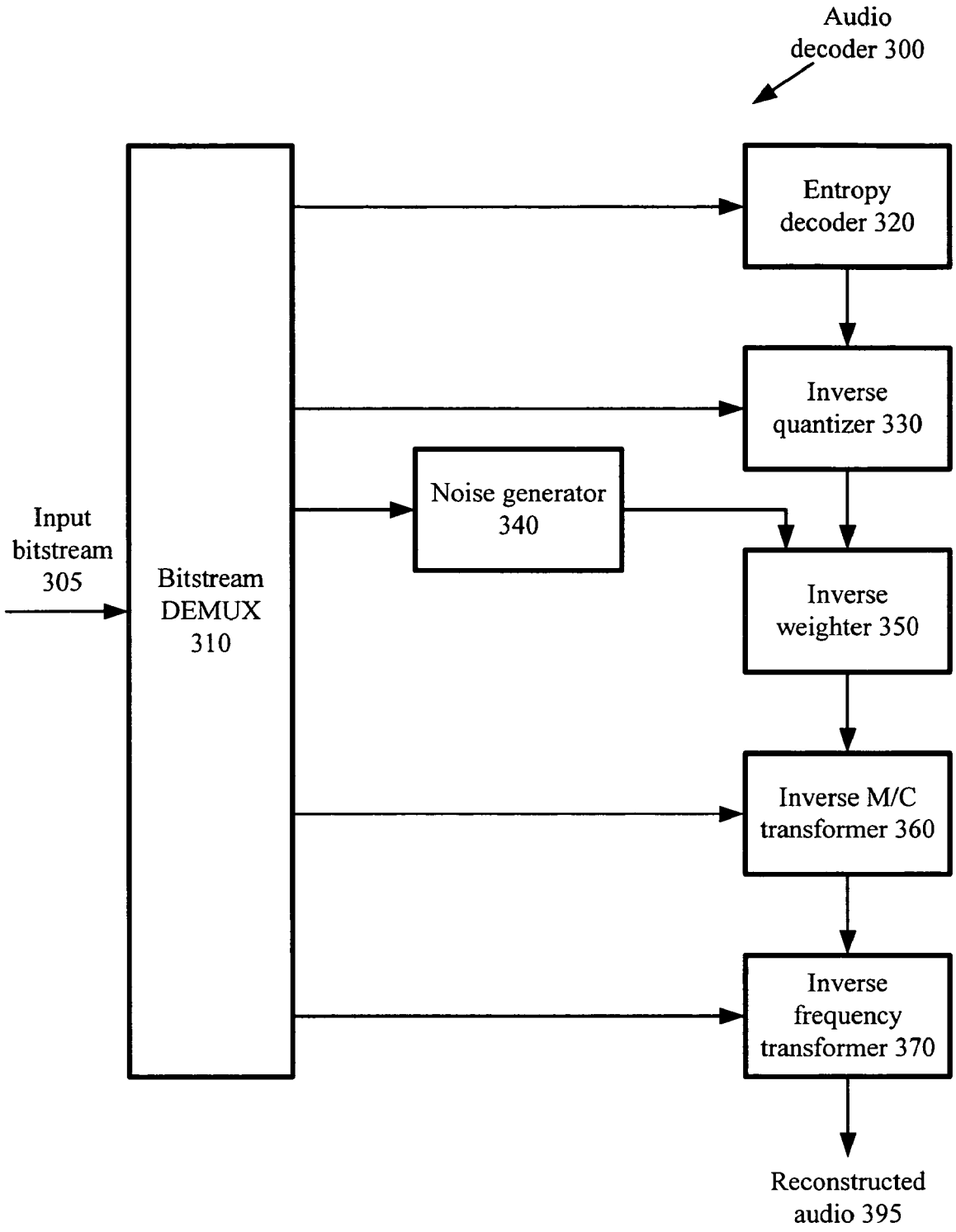

FIG. 2 shows a first audio encoder 200 in which one or more described embodiments may be implemented. The encoder 200 is a transform-based, perceptual audio encoder 200. FIG. 3 shows a corresponding audio decoder 300.

Figure 4:
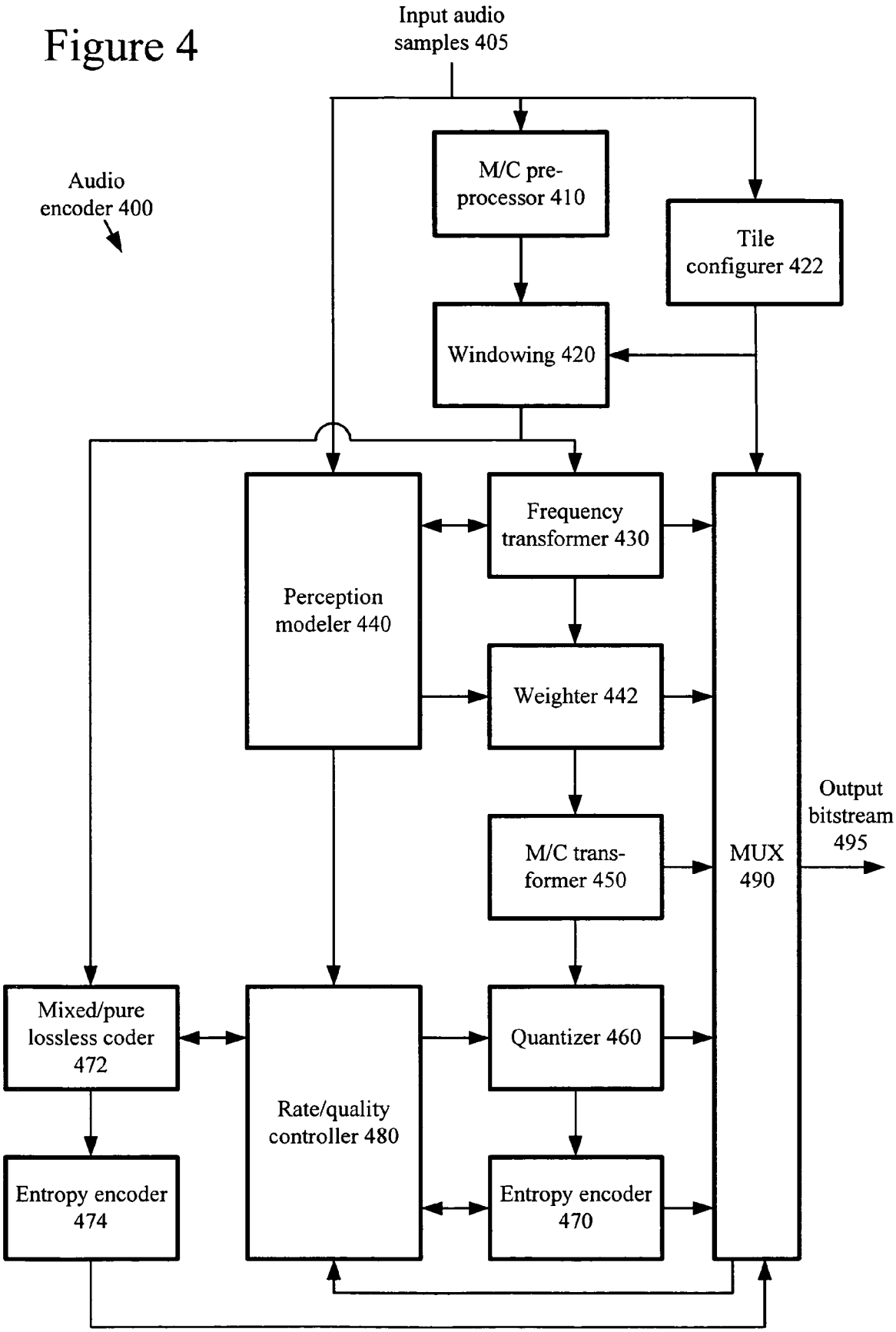
Figure 5:
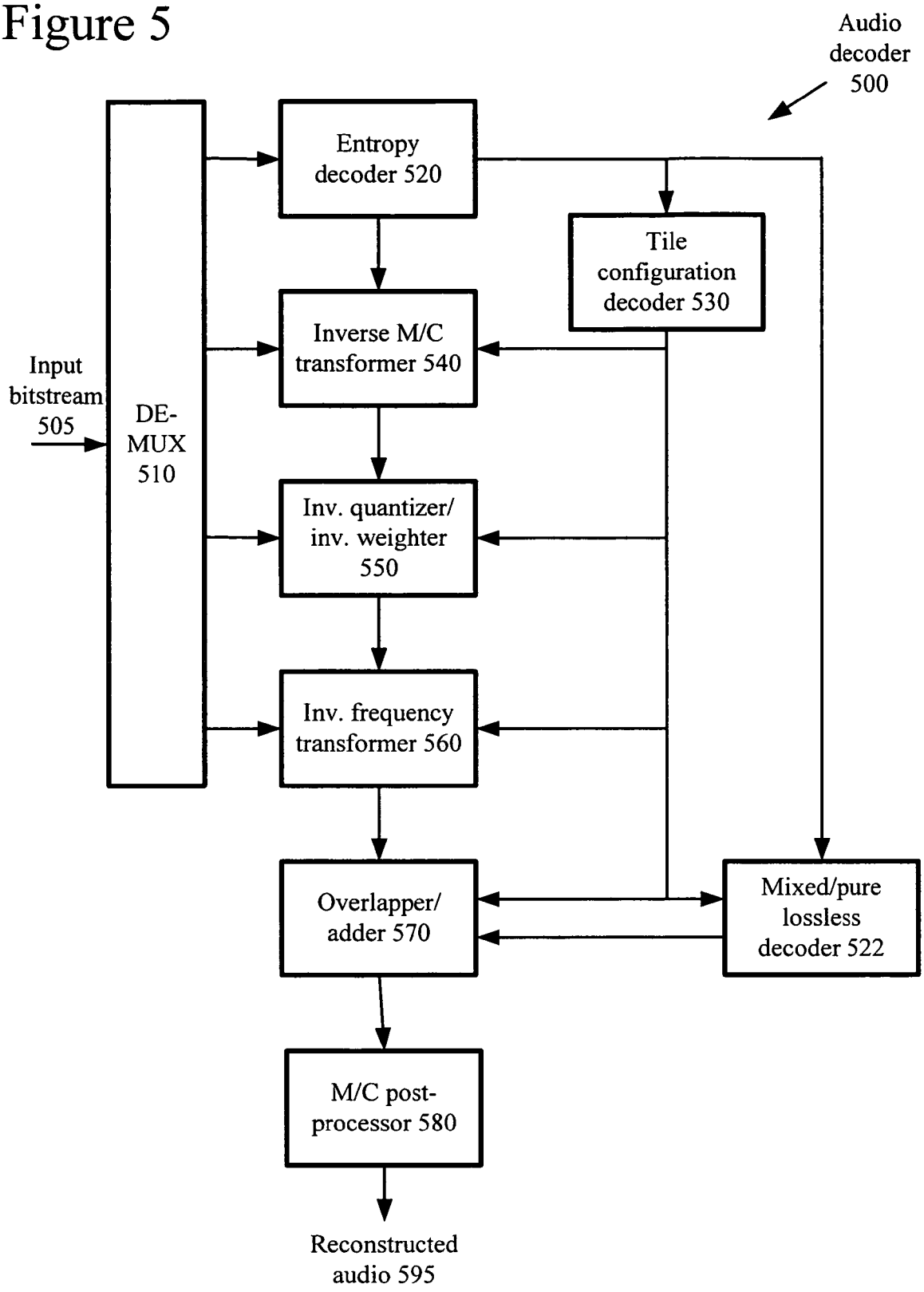

FIG. 4 shows a second audio encoder 400 in which one or more described embodiments may be implemented. The encoder 400 is again a transform-based, perceptual audio encoder, but the encoder 400 includes additional modules, such as modules for processing multi-channel audio. FIG. 5 shows a corresponding audio decoder 500.

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments.

A. First Audio Encoder

The encoder 200 receives a time series of input audio samples 205 at some sampling depth and rate. The input audio samples 205 are for multi-channel audio (e.g., stereo) or mono audio. The encoder 200 compresses the audio samples 205 and multiplexes information produced by the various modules of the encoder 200 to output a bitstream 295 in a compression format such as a WMA format, a container format such as Advanced Streaming Format ("ASF"), or other compression or container format.

The frequency transformer 210 receives the audio samples 205 and converts them into data in the frequency (or spectral) domain. For example, the frequency transformer 210 splits the audio samples 205 of frames into sub-frame blocks, which can have variable size to allow variable temporal resolution. Blocks can overlap to reduce perceptible discontinuities between blocks that could otherwise be introduced by later quantization. The frequency transformer 210 applies to blocks a time-varying Modulated Lapped Transform ("MLT"), modulated DCT ("MDCT"), some other variety of MLT or DCT, or some other type of modulated or non-modulated, overlapped or non-overlapped frequency transform, or uses sub-band or wavelet coding. The frequency transformer 210 outputs blocks of spectral coefficient data and outputs side information such as block sizes to the multiplexer ("MUX") 280.

For multi-channel audio data, the multi-channel transformer 220 can convert the multiple original, independently coded channels into jointly coded channels. Or, the multi-channel transformer 220 can pass the left and right channels through as independently coded channels. The multi-channel transformer 220 produces side information to the MUX 280 indicating the channel mode used. The encoder 200 can apply multi-channel rematrixing to a block of audio data after a multi-channel transform.

The perception modeler 230 models properties of the human auditory system to improve the perceived quality of the reconstructed audio signal for a given bitrate. The perception modeler 230 uses any of various auditory models and passes excitation pattern information or other information to the weighter 240. For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler 230 outputs information that the weighter 240 uses to shape noise in the audio data to reduce the audibility of the noise. For example, using any of various techniques, the weighter 240 generates weighting factors for quantization matrices (sometimes called masks) based upon the received information. The weighting factors for a quantization matrix include a weight for each of multiple quantization bands in the matrix, where the quantization bands are frequency ranges of frequency coefficients. Thus, the weighting factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa.

The weighter 240 then applies the weighting factors to the data received from the multi-channel transformer 220.

The quantizer 250 quantizes the output of the weighter 240, producing quantized coefficient data to the entropy encoder 260 and side information including quantization step size to the MUX 280. In FIG. 2, the quantizer 250 is an adaptive, uniform, scalar quantizer. The quantizer 250 applies the same quantization step size to each spectral coefficient, but the quantization step size itself can change from one iteration of a quantization loop to the next to affect the bitrate of the entropy encoder 260 output. Other kinds of quantization are non-uniform, vector quantization, and/or non-adaptive quantization.

The entropy encoder 260 losslessly compresses quantized coefficient data received from the quantizer 250, for example, performing run-level coding and vector variable length coding. The entropy encoder 260 can compute the number of bits spent encoding audio information and pass this information to the rate/quality controller 270.

The controller 270 works with the quantizer 250 to regulate the bitrate and/or quality of the output of the encoder 200. The controller 270 outputs the quantization step size to the quantizer 250 with the goal of satisfying bitrate and quality constraints.

In addition, the encoder 200 can apply noise substitution and/or band truncation to a block of audio data.

The MUX 280 multiplexes the side information received from the other modules of the audio encoder 200 along with the entropy encoded data received from the entropy encoder 260. The MUX 280 can include a virtual buffer that stores the bitstream 295 to be output by the encoder 200.

B. First Audio Decoder

The decoder 300 receives a bitstream 305 of compressed audio information including entropy encoded data as well as side information, from which the decoder 300 reconstructs audio samples 395.

The demultiplexer ("DEMUX") 310 parses information in the bitstream 305 and sends information to the modules of the decoder 300. The DEMUX 310 includes one or more buffers to compensate for short-term variations in bitrate due to fluctuations in complexity of the audio, network jitter, and/or other factors.

The entropy decoder 320 losslessly decompresses entropy codes received from the DEMUX 310, producing quantized spectral coefficient data. The entropy decoder 320 typically applies the inverse of the entropy encoding techniques used in the encoder.

The inverse quantizer 330 receives a quantization step size from the DEMUX 310 and receives quantized spectral coefficient data from the entropy decoder 320. The inverse quantizer 330 applies the quantization step size to the quantized frequency coefficient data to partially reconstruct the frequency coefficient data, or otherwise performs inverse quantization.

From the DEMUX 310, the noise generator 340 receives information indicating which bands in a block of data are noise substituted as well as any parameters for the form of the noise. The noise generator 340 generates the patterns for the indicated bands, and passes the information to the inverse weighter 350.

The inverse weighter 350 receives the weighting factors from the DEMUX 310, patterns for any noise-substituted bands from the noise generator 340, and the partially reconstructed frequency coefficient data from the inverse quantizer 330. As necessary, the inverse weighter 350 decompresses weighting factors. The inverse weighter 350 applies the weighting factors to the partially reconstructed frequency coefficient data for bands that have not been noise substituted. The inverse weighter 350 then adds in the noise patterns received from the noise generator 340 for the noise-substituted bands.

The inverse multi-channel transformer 360 receives the reconstructed spectral coefficient data from the inverse weighter 350 and channel mode information from the DEMUX 310. If multi-channel audio is in independently coded channels, the inverse multi-channel transformer 360 passes the channels through. If multi-channel data is in jointly coded channels, the inverse multi-channel transformer 360 converts the data into independently coded channels.

The inverse frequency transformer 370 receives the spectral coefficient data output by the multi-channel transformer 360 as well as side information such as block sizes from the DEMUX 310. The inverse frequency transformer 370 applies the inverse of the frequency transform used in the encoder and outputs blocks of reconstructed audio samples 395.

C. Second Audio Encoder

With reference to FIG. 4, the encoder 400 receives a time series of input audio samples 405 at some sampling depth and rate. The input audio samples 405 are for multi-channel audio (e.g., stereo, surround) or mono audio. The encoder 400 compresses the audio samples 405 and multiplexes information produced by the various modules of the encoder 400 to output a bitstream 495 in a compression format such as a WMA Pro format, a container format such as ASF, or other compression or container format.

The encoder 400 selects between multiple encoding modes for the audio samples 405. In FIG. 4, the encoder 400 switches between a mixed/pure lossless coding mode and a lossy coding mode. The lossless coding mode includes the mixed/pure lossless coder 472 and is typically used for high quality (and high bitrate) compression. The lossy coding mode includes components such as the weighter 442 and quantizer 460 and is typically used for adjustable quality (and controlled bitrate) compression. The selection decision depends upon user input or other criteria.

For lossy coding of multi-channel audio data, the multi-channel pre-processor 410 optionally re-matrixes the time-domain audio samples 405. For example, the multi-channel pre-processor 410 selectively re-matrixes the audio samples 405 to drop one or more coded channels or increase inter-channel correlation in the encoder 400, yet allow reconstruction (in some form) in the decoder 500. The multi-channel pre-processor 410 may send side information such as instructions for multi-channel post-processing to the MUX 490.

The windowing module 420 partitions a frame of audio input samples 405 into sub-frame blocks (windows). The windows may have time-varying size and window shaping functions. When the encoder 400 uses lossy coding, variable-size windows allow variable temporal resolution. The windowing module 420 outputs blocks of partitioned data and outputs side information such as block sizes to the MUX 490.

In FIG. 4, the tile configurer 422 partitions frames of multi-channel audio on a per-channel basis. The tile configurer 422 independently partitions each channel in the frame, if quality/bitrate allows. This allows, for example, the tile configurer 422 to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer 422 groups windows of the same size that are co-located in time as a tile.

Figure 6:
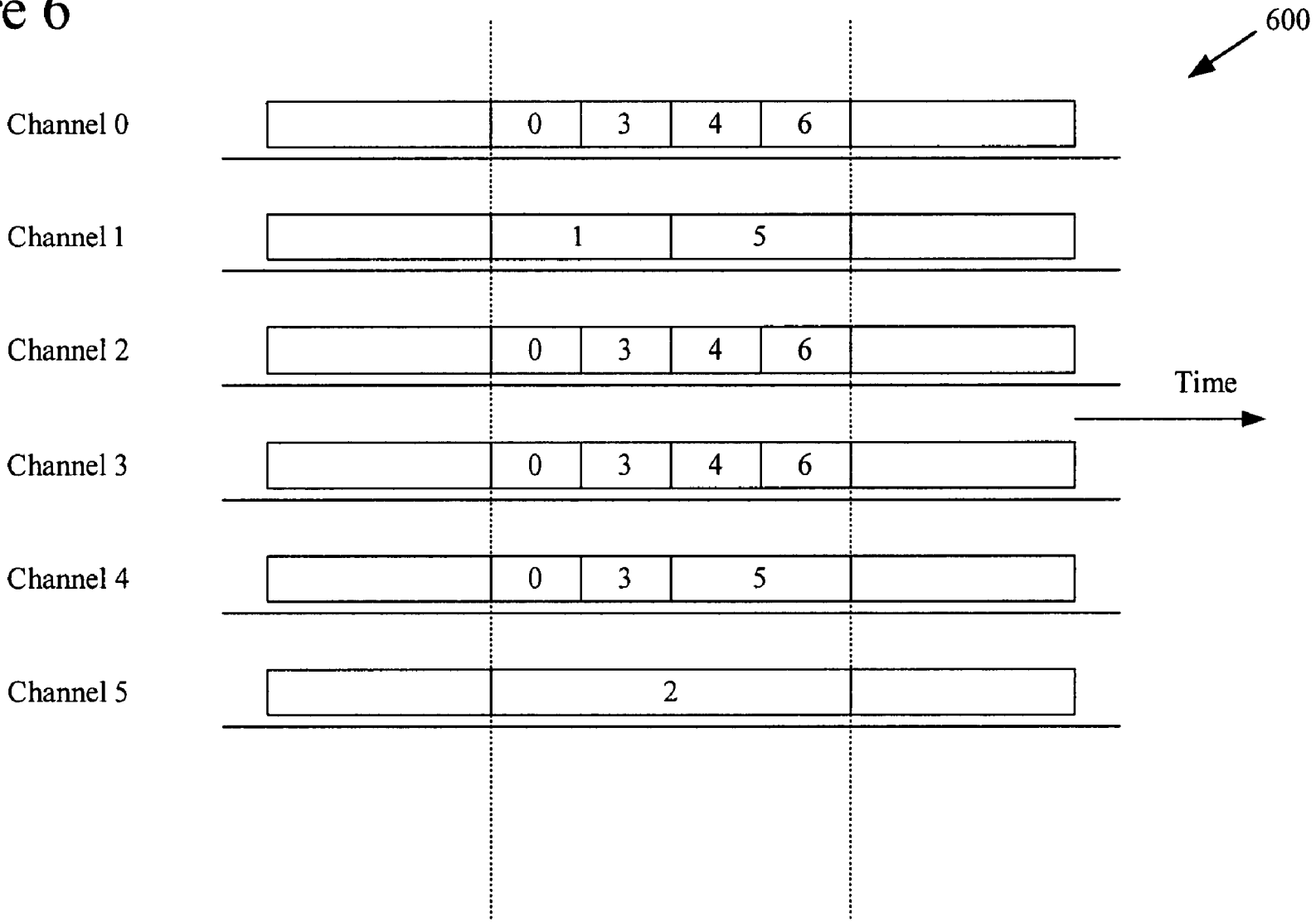
FIG. 6 is a diagram showing an example tile configuration.

FIG. 6 shows an example tile configuration 600 for a frame of 5.1 channel audio. The tile configuration 600 includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown, a particular tile can include windows in non-contiguous channels.

The frequency transformer 430 receives audio samples and converts them into data in the frequency domain, applying a transform such as described above for the frequency transformer 210 of FIG. 2. The frequency transformer 430 outputs blocks of spectral coefficient data to the weighter 442 and outputs side information such as block sizes to the MUX 490. The frequency transformer 430 outputs both the frequency coefficients and the side information to the perception modeler 440.

The perception modeler 440 models properties of the human auditory system, processing audio data according to an auditory model, generally as described above with reference to the perception modeler 230 of FIG. 2.

The weighter 442 generates weighting factors for quantization matrices based upon the information received from the perception modeler 440, generally as described above with reference to the weighter 240 of FIG. 2. The weighter 442 applies the weighting factors to the data received from the frequency transformer 430. The weighter 442 outputs side information such as the quantization matrices and channel weight factors to the MUX 490. The quantization matrices can be compressed.

For multi-channel audio data, the multi-channel transformer 450 may apply a multi-channel transform to take advantage of inter-channel correlation. For example, the multi-channel transformer 450 selectively and flexibly applies the multi-channel transform to some but not all of the channels and/or quantization bands in the tile. The multi-channel transformer 450 selectively uses pre-defined matrices or custom matrices, and applies efficient compression to the custom matrices. The multi-channel transformer 450 produces side information to the MUX 490 indicating, for example, the multi-channel transforms used and multi-channel transformed parts of tiles.

The quantizer 460 quantizes the output of the multi-channel transformer 450, producing quantized coefficient data to the entropy encoder 470 and side information including quantization step sizes to the MUX 490. In FIG. 4, the quantizer 460 is an adaptive, uniform, scalar quantizer that computes a quantization factor per tile, but the quantizer 460 may instead perform some other kind of quantization.

The entropy encoder 470 losslessly compresses quantized coefficient data received from the quantizer 460, generally as described above with reference to the entropy encoder 260 of FIG. 2.

The controller 480 works with the quantizer 460 to regulate the bitrate and/or quality of the output of the encoder 400. The controller 480 outputs the quantization factors to the quantizer 460 with the goal of satisfying quality and/or bitrate constraints.

The mixed/pure lossless encoder 472 and associated entropy encoder 474 compress audio data for the mixed/pure lossless coding mode. The encoder 400 uses the mixed/pure lossless coding mode for an entire sequence or switches between coding modes on a frame-by-frame, block-by-block, tile-by-tile, or other basis.

The MUX 490 multiplexes the side information received from the other modules of the audio encoder 400 along with the entropy encoded data received from the entropy encoders 470, 474. The MUX 490 includes one or more buffers for rate control or other purposes.

D. Second Audio Decoder

With reference to FIG. 5, the second audio decoder 500 receives a bitstream 505 of compressed audio information. The bitstream 505 includes entropy encoded data as well as side information from which the decoder 500 reconstructs audio samples 595.

The DEMUX 510 parses information in the bitstream 505 and sends information to the modules of the decoder 500. The DEMUX 510 includes one or more buffers to compensate for short-term variations in bitrate due to fluctuations in complexity of the audio, network jitter, and/or other factors.

The entropy decoder 520 losslessly decompresses entropy codes received from the DEMUX 510, typically applying the inverse of the entropy encoding techniques used in the encoder 400. When decoding data compressed in lossy coding mode, the entropy decoder 520 produces quantized spectral coefficient data.

The mixed/pure lossless decoder 522 and associated entropy decoder(s) 520 decompress losslessly encoded audio data for the mixed/pure lossless coding mode.

The tile configuration decoder 530 receives and, if necessary, decodes information indicating the patterns of tiles for frames from the DEMUX 590. The tile pattern information may be entropy encoded or otherwise parameterized. The tile configuration decoder 530 then passes tile pattern information to various other modules of the decoder 500.

The inverse multi-channel transformer 540 receives the quantized spectral coefficient data from the entropy decoder 520 as well as tile pattern information from the tile configuration decoder 530 and side information from the DEMUX 510 indicating, for example, the multi-channel transform used and transformed parts of tiles. Using this information, the inverse multi-channel transformer 540 decompresses the transform matrix as necessary, and selectively and flexibly applies one or more inverse multi-channel transforms to the audio data.

The inverse quantizer/weighter 550 receives information such as tile and channel quantization factors as well as quantization matrices from the DEMUX 510 and receives quantized spectral coefficient data from the inverse multi-channel transformer 540. The inverse quantizer/weighter 550 decompresses the received weighting factor information as necessary. The quantizer/weighter 550 then performs the inverse quantization and weighting.

The inverse frequency transformer 560 receives the spectral coefficient data output by the inverse quantizer/weighter 550 as well as side information from the DEMUX 510 and tile pattern information from the tile configuration decoder 530. The inverse frequency transformer 570 applies the inverse of the frequency transform used in the encoder and outputs blocks to the overlapper/adder 570.

In addition to receiving tile pattern information from the tile configuration decoder 530, the overlapper/adder 570 receives decoded information from the inverse frequency transformer 560 and/or mixed/pure lossless decoder 522. The overlapper/adder 570 overlaps and adds audio data as necessary and interleaves frames or other sequences of audio data encoded with different modes.

The multi-channel post-processor 580 optionally re-matrixes the time-domain audio samples output by the overlapper/adder 570. For bitstream-controlled post-processing, the post-processing transform matrices vary over time and are signaled or included in the bitstream 505.

III. Overview of Multi-Channel Processing

This section is an overview of some multi-channel processing techniques used in some encoders and decoders, including multi-channel pre-processing techniques, flexible multi-channel transform techniques, and multi-channel post-processing techniques.

A. Multi-Channel Pre-processing

Some encoders perform multi-channel pre-processing on input audio samples in the time domain.

In traditional encoders, when there are N source audio channels as input, the number of output channels produced by the encoder is also N. The number of coded channels may correspond one-to-one with the source channels, or the coded channels may be multi-channel transform-coded channels. When the coding complexity of the source makes compression difficult or when the encoder buffer is full, however, the encoder may alter or drop (i.e., not code) one or more of the original input audio channels or multi-channel transform-coded channels. This can be done to reduce coding complexity and improve the overall perceived quality of the audio. For quality-driven pre-processing, an encoder may perform multi-channel pre-processing in reaction to measured audio quality so as to smoothly control overall audio quality and/or channel separation.

For example, an encoder may alter a multi-channel audio image to make one or more channels less critical so that the channels are dropped at the encoder yet reconstructed at a decoder as "phantom" or uncoded channels. This helps to avoid the need for outright deletion of channels or severe quantization, which can have a dramatic effect on quality.

An encoder can indicate to the decoder what action to take when the number of coded channels is less than the number of channels for output. Then, a multi-channel post-processing transform can be used in a decoder to create phantom channels. For example, an encoder (through a bitstream) can instruct a decoder to create a phantom center by averaging decoded left and right channels. Later multi-channel transformations may exploit redundancy between averaged back left and back right channels (without post-processing), or an encoder may instruct a decoder to perform some multi-channel post-processing for back left and right channels. Or, an encoder can signal to a decoder to perform multi-channel post-processing for another purpose.

Figure 7:
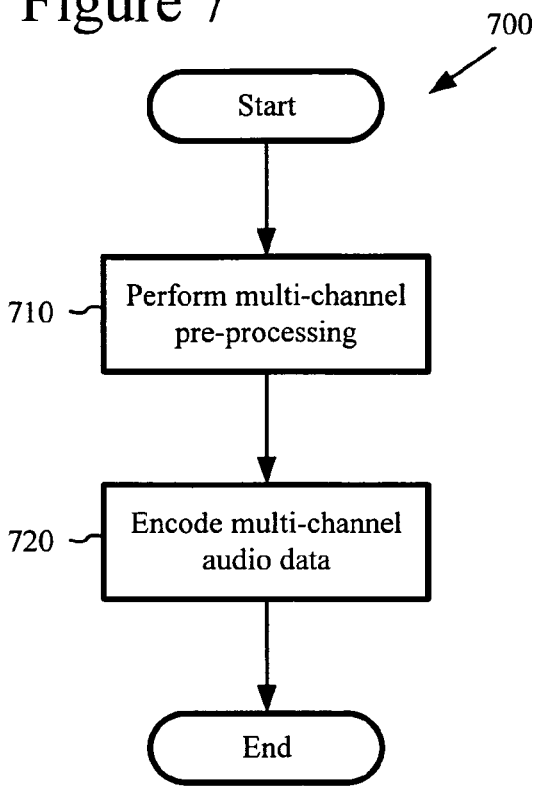
FIG. 7 is a flow chart showing a generalized technique for multi-channel pre-processing.

FIG. 7 shows a generalized technique 700 for multi-channel pre-processing. An encoder performs (710) multi-channel pre-processing on time-domain multi-channel audio data, producing transformed audio data in the time domain. For example, the pre-processing involves a general transform matrix with real, continuous valued elements. The general transform matrix can be chosen to artificially increase inter-channel correlation. This reduces complexity for the rest of the encoder, but at the cost of lost channel separation.

The output is then fed to the rest of the encoder, which, in addition to any other processing that the encoder may perform, encodes (720) the data using techniques described with reference to FIG. 4 or other compression techniques, producing encoded multi-channel audio data.

A syntax used by an encoder and decoder may allow description of general or pre-defined post-processing multi-channel transform matrices, which can vary or be turned on/off on a frame-to-frame basis. An encoder can use this flexibility to limit stereo/surround image impairments, trading off channel separation for better overall quality in certain circumstances by artificially increasing inter-channel correlation. Alternatively, a decoder and encoder can use another syntax for multi-channel pre- and post-processing, for example, one that allows changes in transform matrices on a basis other than frame-to-frame.

B. Flexible Multi-Channel Transforms

Some encoders can perform flexible multi-channel transforms that effectively take advantage of inter-channel correlation. Corresponding decoders can perform corresponding inverse multi-channel transforms.

For example, an encoder can position a multi-channel transform after perceptual weighting (and the decoder can position the inverse multi-channel transform before inverse weighting) such that a cross-channel leaked signal is controlled, measurable, and has a spectrum like the original signal. An encoder can apply weighting factors to multi-channel audio in the frequency domain (e.g., both weighting factors and per-channel quantization step modifiers) before multi-channel transforms. An encoder can perform one or more multi-channel transforms on weighted audio data, and quantize multi-channel transformed audio data.

A decoder can collect samples from multiple channels at a particular frequency index into a vector and perform an inverse multi-channel transform to generate the output. Subsequently, a decoder can inverse quantize and inverse weight the multi-channel audio, coloring the output of the inverse multi-channel transform with mask(s). Thus, leakage that occurs across channels (due to quantization) can be spectrally shaped so that the leaked signal's audibility is measurable and controllable, and the leakage of other channels in a given reconstructed channel is spectrally shaped like the original uncorrupted signal of the given channel.

An encoder can group channels for multi-channel transforms to limit which channels get transformed together. For example, an encoder can determine which channels within a tile correlate and group the correlated channels. An encoder can consider pair-wise correlations between signals of channels as well as correlations between bands, or other and/or additional factors when grouping channels for multi-channel transformation. For example, an encoder can compute pair-wise correlations between signals in channels and then group channels accordingly. A channel that is not pair-wise correlated with any of the channels in a group may still be compatible with that group. For channels that are incompatible with a group, an encoder can check compatibility at band level and adjust one or more groups of channels accordingly. An encoder can identify channels that are compatible with a group in some bands, but incompatible in some other bands. Turning off a transform at incompatible bands can improve correlation among bands that actually get multi-channel transform coded and improve coding efficiency. Channels in a channel group need not be contiguous. A single tile may include multiple channel groups, and each channel group may have a different associated multi-channel transform. After deciding which channels are compatible, an encoder can put channel group information into a bitstream. A decoder can then retrieve and process the information from the bitstream.

An encoder can selectively turn multi-channel transforms on or off at the frequency band level to control which bands are transformed together. In this way, an encoder can selectively exclude bands that are not compatible in multi-channel transforms. When a multi-channel transform is turned off for a particular band, an encoder can use the identity transform for that band, passing through the data at that band without altering it. The number of frequency bands relates to the sampling frequency of the audio data and the tile size. In general, the higher the sampling frequency or larger the tile size, the greater the number of frequency bands. An encoder can selectively turn multi-channel transforms on or off at the frequency band level for channels of a channel group of a tile. A decoder can retrieve band on/off information for a multi-channel transform for a channel group of a tile from a bitstream according to a particular bitstream syntax.

An encoder can use hierarchical multi-channel transforms to limit computational complexity, especially in the decoder. With a hierarchical transform, an encoder can split an overall transformation into multiple stages, reducing the computational complexity of individual stages and in some cases reducing the amount of information needed to specify multi-channel transforms. Using this cascaded structure, an encoder can emulate the larger overall transform with smaller transforms, up to some accuracy. A decoder can then perform a corresponding hierarchical inverse transform. An encoder may combine frequency band on/off information for the multiple multi-channel transforms. A decoder can retrieve information for a hierarchy of multi-channel transforms for channel groups from a bitstream according to a particular bitstream syntax.

An encoder can use pre-defined multi-channel transform matrices to reduce the bitrate used to specify transform matrices. An encoder can select from among multiple available pre-defined matrix types and signal the selected matrix in the bitstream. Some types of matrices may require no additional signaling in the bitstream. Others may require additional specification. A decoder can retrieve the information indicating the matrix type and (if necessary) the additional information specifying the matrix.

An encoder can compute and apply quantization matrices for channels of tiles, per-channel quantization step modifiers, and overall quantization tile factors. This allows an encoder to shape noise according to an auditory model, balance noise between channels, and control overall distortion. A corresponding decoder can decode apply overall quantization tile factors, per-channel quantization step modifiers, and quantization matrices for channels of tiles, and can combine inverse quantization and inverse weighting steps.

C. Multi-Channel Post-Processing

Some decoders perform multi-channel post-processing on reconstructed audio samples in the time domain.

For example, the number of decoded channels may be less than the number of channels for output (e.g., because the encoder did not code one or more input channels). If so, a multi-channel post-processing transform can be used to create one or more "phantom" channels based on actual data in the decoded channels. If the number of decoded channels equals the number of output channels, the post-processing transform can be used for arbitrary spatial rotation of the presentation, remapping of output channels between speaker positions, or other spatial or special effects. If the number of decoded channels is greater than the number of output channels (e.g., playing surround sound audio on stereo equipment), a post-processing transform can be used to "fold-down" channels. Transform matrices for these scenarios and applications can be provided or signaled by the encoder.

Figure 8:
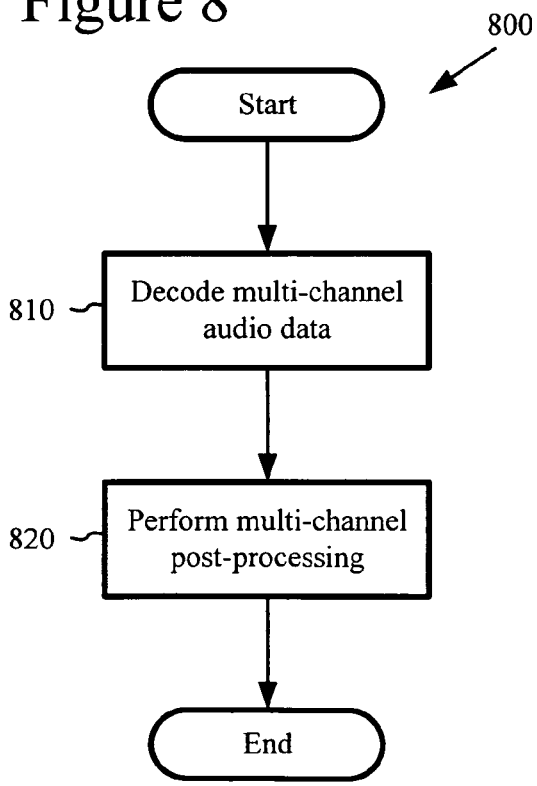
FIG. 8 is a flow chart showing a generalized technique for multi-channel post-processing.

FIG. 8 shows a generalized technique 800 for multi-channel post-processing. The decoder decodes (810) encoded multi-channel audio data, producing reconstructed time-domain multi-channel audio data.

The decoder then performs (820) multi-channel post-processing on the time-domain multi-channel audio data. When the encoder produces a number of coded channels and the decoder outputs a larger number of channels, the post-processing involves a general transform to produce the larger number of output channels from the smaller number of coded channels. For example, the decoder takes co-located (in time) samples, one from each of the reconstructed coded channels, then pads any channels that are missing (i.e., the channels dropped by the encoder) with zeros. The decoder multiplies the samples with a general post-processing transform matrix.

The general post-processing transform matrix can be a matrix with pre-determined elements, or it can be a general matrix with elements specified by the encoder. The encoder signals the decoder to use a pre-determined matrix (e.g., with one or more flag bits) or sends the elements of a general matrix to the decoder, or the decoder may be configured to always use the same general post-processing transform matrix. For additional flexibility, the multi-channel post-processing can be turned on/off on a frame-by-frame or other basis (in which case, the decoder may use an identity matrix to leave channels unaltered).

For more information on multi-channel pre-processing, post-processing, and flexible multi-channel transforms, see U.S. Patent Application Publication No. 2004-0049379, entitled "Multi-Channel Audio Encoding and Decoding."

IV. Channel Extension Processing for Multi-Channel Audio

In a typical coding scheme for coding a multi-channel source, a time-to-frequency transformation using a transform such as a modulated lapped transform ("MLT") or discrete cosine transform ("DCT") is performed at an encoder, with a corresponding inverse transform at the decoder. MLT or DCT coefficients for some of the channels are grouped together into a channel group and a linear transform is applied across the channels to obtain the channels that are to be coded. If the left and right channels of a stereo source are correlated, they can be coded using a sum-difference transform (also called M/S or mid/side coding). This removes correlation between the two channels, resulting in fewer bits needed to code them. However, at low bitrates, the difference channel may not be coded (resulting in loss of stereo image), or quality may suffer from heavy quantization of both channels.

Described techniques and tools provide a desirable alternative to existing joint coding schemes (e.g., mid/side coding, intensity stereo coding, etc.). Instead of coding sum and difference channels for channel groups (e.g., left/right pairs, front left/front right pairs, back left/back right pairs, or other groups), described techniques and tools code one or more combined channels (which may be sums of channels, a principal major component after applying a de-correlating transform, or some other combined channel) along with additional parameters to describe the cross-channel correlation and power of the respective physical channels and allow reconstruction of the physical channels that maintains the cross-channel correlation and power of the respective physical channels. In other words, second order statistics of the physical channels are maintained. Such processing can be referred to as channel extension processing.

For example, using complex transforms allows channel reconstruction that maintains cross-channel correlation and power of the respective channels. For a narrowband signal approximation, maintaining second-order statistics is sufficient to provide a reconstruction that maintains the power and phase of individual channels, without sending explicit correlation coefficient information or phase information.

Described techniques and tools represent uncoded channels as modified versions of coded channels. Channels to be coded can be actual, physical channels or transformed versions of physical channels (using, for example, a linear transform applied to each sample). For example, described techniques and tools allow reconstruction of plural physical channels using one coded channel and plural parameters. In one implementation, the parameters include ratios of power (also referred to as intensity or energy) between two physical channels and a coded channel on a per-band basis. For example, to code a signal having left (L) and right (R) stereo channels, the power ratios are L/M and R/M, where M is the power of the coded channel (the "sum" or "mono" channel), L is the power of left channel, and R is the power of the right channel. Although channel extension coding can be used for all frequency ranges, this is not required. For example, for lower frequencies an encoder can code both channels of a channel transform (e.g., using sum and difference), while for higher frequencies an encoder can code the sum channel and plural parameters.

Described embodiments can significantly reduce the bitrate needed to code a multi-channel source. The parameters for modifying the channels take up a small portion of the total bitrate, leaving more bitrate for coding combined channels. For example, for a two channel source, if coding the parameters takes 10% of the available bitrate, 90% of the bits can be used to code the combined channel. In many cases, this is a significant savings over coding both channels, even after accounting for cross-channel dependencies.

Channels can be reconstructed at a reconstructed channel/coded channel ratio other than the 2:1 ratio described above. For example, a decoder can reconstruct left and right channels and a center channel from a single coded channel. Other arrangements also are possible. Further, the parameters can be defined different ways. For example, the parameters may be defined on some basis other than a per-band basis.

A. Complex Transforms and Scale/Shape Parameters

In described embodiments, an encoder forms a combined channel and provides parameters to a decoder for reconstruction of the channels that were used to form the combined channel. A decoder derives complex coefficients (each having a real component and an imaginary component) for the combined channel using a forward complex transform. Then, to reconstruct physical channels from the combined channel, the decoder scales the complex coefficients using the parameters provided by the encoder. For example, the decoder derives scale factors from the parameters provided by the encoder and uses them to scale the complex coefficients. The combined channel is often a sum channel (sometimes referred to as a mono channel) but also may be another combination of physical channels. The combined channel may be a difference channel (e.g., the difference between left and right channels) in cases where physical channels are out of phase and summing the channels would cause them to cancel each other out.

For example, the encoder sends a sum channel for left and right physical channels and plural parameters to a decoder which may include one or more complex parameters. (Complex parameters are derived in some way from one or more complex numbers, although a complex parameter sent by an encoder (e.g., a ratio that involves an imaginary number and a real number) may not itself be a complex number.) The encoder also may send only real parameters from which the decoder can derive complex scale factors for scaling spectral coefficients. (The encoder typically does not use a complex transform to encode the combined channel itself. Instead, the encoder can use any of several encoding techniques to encode the combined channel.)

Figure 9:
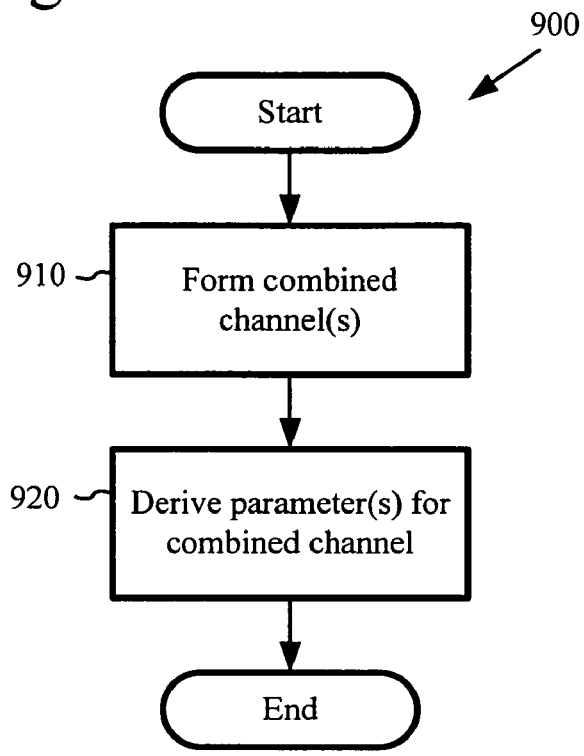
FIG. 9 is a flow chart showing a technique for deriving complex scale factors for combined channels in channel extension encoding.
Figure 10:
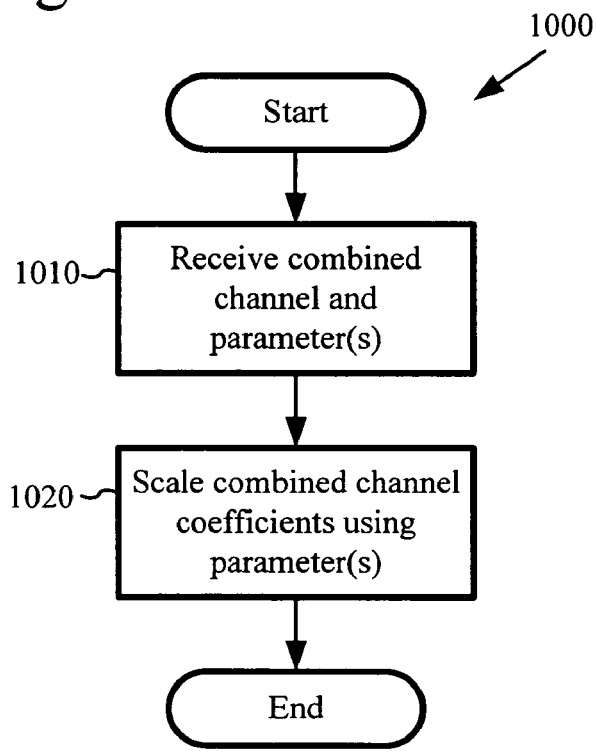
FIG. 10 is a flow chart showing a technique for using complex scale factors in channel extension decoding.

FIG. 9 shows a simplified channel extension coding technique 900 performed by an encoder. At 910, the encoder forms one or more combined channels (e.g., sum channels). Then, at 920, the encoder derives one or more parameters to be sent along with the combined channel to a decoder. FIG. 10 shows a simplified inverse channel extension decoding technique 1000 performed by a decoder. At 1010, the decoder receives one or more parameters for one or more combined channels. Then, at 1020, the decoder scales combined channel coefficients using the parameters. For example, the decoder derives complex scale factors from the parameters and uses the scale factors to scale the coefficients.

After a time-to-frequency transform at an encoder, the spectrum of each channel is usually divided into sub-bands. In described embodiments, an encoder can determine different parameters for different frequency sub-bands, and a decoder can scale coefficients in a band of the combined channel for the respective band in the reconstructed channel using one or more parameters provided by the encoder. In a coding arrangement where left and right channels are to be reconstructed from one coded channel, each coefficient in the sub-band for each of the left and right channels is represented by a scaled version of a sub-band in the coded channel.

Figure 11:
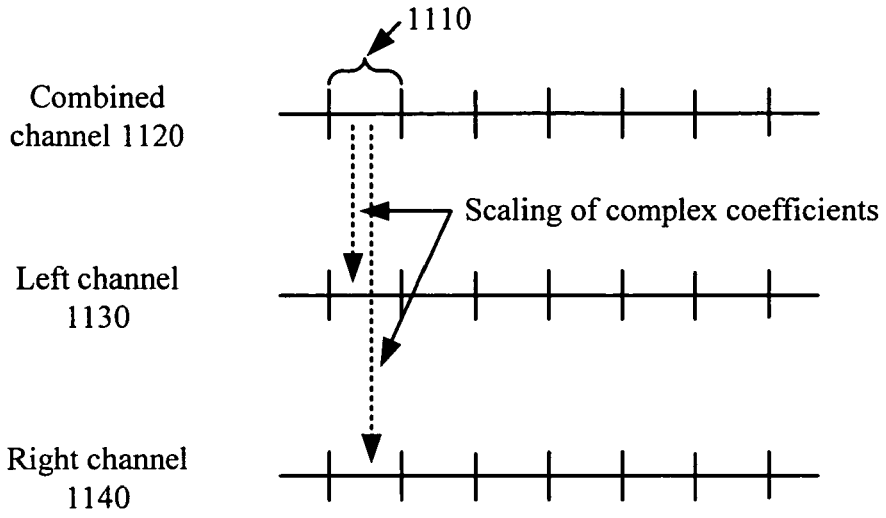
FIG. 11 is a diagram showing scaling of combined channel coefficients in channel reconstruction.

For example, FIG. 11 shows scaling of coefficients in a band 1110 of a combined channel 1120 during channel reconstruction. The decoder uses one or more parameters provided by the encoder to derive scaled coefficients in corresponding sub-bands for the left channel 1230 and the right channel 1240 being reconstructed by the decoder.

In one implementation, each sub-band in each of the left and right channels has a scale parameter and a shape parameter. The shape parameter may be determined by the encoder and sent to the decoder, or the shape parameter may be assumed by taking spectral coefficients in the same location as those being coded. The encoder represents all the frequencies in one channel using scaled version of the spectrum from one or more of the coded channels. A complex transform (having a real number component and an imaginary number component) is used, so that cross-channel second-order statistics of the channels can be maintained for each sub-band. Because coded channels are a linear transform of actual channels, parameters do not need to be sent for all channels. For example, if P channels are coded using N channels (where N<P), then parameters do not need to be sent for all P channels. More information on scale and shape parameters is provided below in Section V.

The parameters may change over time as the power ratios between the physical channels and the combined channel change. Accordingly, the parameters for the frequency bands in a frame may be determined on a frame by frame basis or some other basis. The parameters for a current band in a current frame are differentially coded based on parameters from other frequency bands and/or other frames in described embodiments.

The decoder performs a forward complex transform to derive the complex spectral coefficients of the combined channel. It then uses the parameters sent in the bitstream (such as power ratios and an imaginary-to-real ratio for the cross-correlation or a normalized correlation matrix) to scale the spectral coefficients. The output of the complex scaling is sent to the post processing filter. The output of this filter is scaled and added to reconstruct the physical channels.

Channel extension coding need not be performed for all frequency bands or for all time blocks. For example, channel extension coding can be adaptively switched on or off on a per band basis, a per block basis, or some other basis. In this way, an encoder can choose to perform this processing when it is efficient or otherwise beneficial to do so. The remaining bands or blocks can be processed by traditional channel decorrelation, without decorrelation, or using other methods.

The achievable complex scale factors in described embodiments are limited to values within certain bounds. For example, described embodiments encode parameters in the log domain, and the values are bound by the amount of possible cross-correlation between channels.

The channels that can be reconstructed from the combined channel using complex transforms are not limited to left and right channel pairs, nor are combined channels limited to combinations of left and right channels. For example, combined channels may represent two, three or more physical channels. The channels reconstructed from combined channels may be groups such as back-left/back-right, back-left/left, back-right/right, left/center, right/center, and left/center/right. Other groups also are possible. The reconstructed channels may all be reconstructed using complex transforms, or some channels may be reconstructed using complex transforms while others are not.

B. Interpolation of Parameters

An encoder can choose anchor points at which to determine explicit parameters and interpolate parameters between the anchor points. The amount of time between anchor points and the number of anchor points may be fixed or vary depending on content and/or encoder-side decisions. When an anchor point is selected at time t, the encoder can use that anchor point for all frequency bands in the spectrum. Alternatively, the encoder can select anchor points at different times for different frequency bands.

Figure 12:
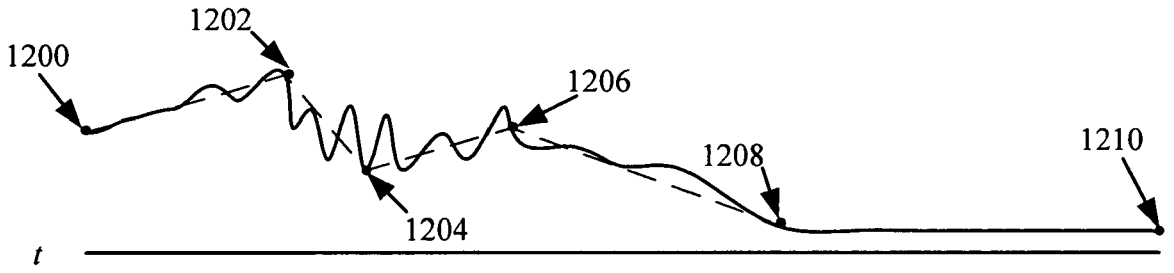
FIG. 12 is a chart showing a graphical comparison of actual power ratios and power ratios interpolated from power ratios at anchor points.

FIG. 12 is a graphical comparison of actual power ratios and power ratios interpolated from power ratios at anchor points. In the example shown in FIG. 12, interpolation smoothes variations in power ratios (e.g., between anchor points 1200 and 1202, 1202 and 1204, 1204 and 1206, and 1206 and 1208) which can help to avoid artifacts from frequently-changing power ratios. The encoder can turn interpolation on or off or not interpolate the parameters at all. For example, the encoder can choose to interpolate parameters when changes in the power ratios are gradual over time, or turn off interpolation when parameters are not changing very much from frame to frame (e.g., between anchor points 1208 and 1210 in FIG. 12), or when parameters are changing so rapidly that interpolation would provide inaccurate representation of the parameters.

C. Detailed Explanation A general linear channel transform can be written as $Y=AX$, where X is a set of L vectors of coefficients from P channels (a $P\times L$ dimensional matrix), A is a $P\times P$ channel transform matrix, and Y is the set of L transformed vectors from the P channels that are to be coded (a $P\times L$ dimensional matrix). L (the vector dimension) is the band size for a given subframe on which the linear channel transform algorithm operates. If an encoder codes a subset N of the P channels in Y, this can be expressed as $Z=BX$, where the vector Z is an $N\times L$ matrix, and B is a $N\times P$ matrix formed by taking N rows of matrix Y corresponding to the N channels which are to be coded. Reconstruction from the N channels involves another matrix multiplication with a matrix C after coding the vector Z to obtain $W=CQ(Z)$, where Q represents quantization of the vector Z. Substituting for Z gives the equation $W=CQ(BX)$. Assuming quantization noise is negligible, $W=CBX$. C can be appropriately chosen to maintain cross-channel second-order statistics between the vector X and W. In equation form, this can be represented as $WW^*=CBXX^*B^*C^*=XX^*$, where $XX^*$ is a symmetric $P\times P$ matrix.

Since $XX^*$ is a symmetric $P\times P$ matrix, there are $P(P+1)/2$ degrees of freedom in the matrix. If $N>=(P+1)/2$, then it may be possible to come up with a $P\times N$ matrix C such that the equation is satisfied. If $N<(P+1)/2$, then more information is needed to solve this. If that is the case, complex transforms can be used to come up with other solutions which satisfy some portion of the constraint.

For example, if X is a complex vector and C is a complex matrix, we can try to find C such that $Re(CBXX^*B^*C^*)=Re(XX^*)$. According to this equation, for an appropriate complex matrix C the real portion of the symmetric matrix $XX^*$ is equal to the real portion of the symmetric matrix product $CBXX^*B^*C^*$.

EXAMPLE 1

For the case where M=2 and N=1, then, $BXX^*B^*$ is simply a real scalar ($L\times 1$) matrix, referred to as $\alpha$. We solve for the equations shown in FIG. 13. If $B_0=B_1=\beta$ (which is some constant) then the constraint in FIG. 14 holds. Solving, we get the values shown in FIG. 15 for $|C_0|$, $|C_1|$ and $|C_0||C_1|\cos(\phi_0-\phi_1)$. The encoder sends $|_0|$ and $|C_1|$. Then we can solve using the constraint shown in FIG. 16. It should be clear from FIG. 15 that these quantities are essentially the power ratios L/M and R/M. The sign in the constraint shown in FIG. 16 can be used to control the sign of the phase so that it matches the imaginary portion of XX*. This allows solving for $\phi_0-\phi_1$, but not for the actual values. In order for to solve for the exact values, another assumption is made that the angle of the mono channel for each coefficient is maintained, as expressed in FIG. 17. To maintain this, it is sufficient that $|C_0|\sin\phi_0+|C_1|\sin\phi_1=0$, which gives the results for $\phi_0$ and $\phi_1$ shown in FIG. 18.

Using the constraint shown in FIG. 16, we can solve for the real and imaginary portions of the two scale factors. For example, the real portion of the two scale factors can be found by solving for $|C_0|\cos\phi_0$ and $|C_1|\cos\phi_1$, respectively, as shown in FIG. 19. The imaginary portion of the two scale factors can be found by solving for $|C_0|\sin\phi_0$ and $|C_1|\sin\phi_1$, respectively, as shown in FIG. 20.

Thus, when the encoder sends the magnitude of the complex scale factors, the decoder is able to reconstruct two individual channels which maintain cross-channel second order characteristics of the original, physical channels, and the two reconstructed channels maintain the proper phase of the coded channel.

EXAMPLE 2

In Example 1, although the imaginary portion of the cross-channel second-order statistics is solved for (as shown in FIG. 20), only the real portion is maintained at the decoder, which is only reconstructing from a single mono source. However, the imaginary portion of the cross-channel second-order statistics also can be maintained if (in addition to the complex scaling) the output from the previous stage as described in Example 1 is post-processed to achieve an additional spatialization effect. The output is filtered through a linear filter, scaled, and added back to the output from the previous stage.

Suppose that in addition to the current signal from the previous analysis ($W_0$ and $W_1$ for the two channels, respectively), the decoder has the effect signal—a processed version of both the channels available ($W_{0F}$ and $W_{1F}$, respectively), as shown in FIG. 21. Then the overall transform can be represented as shown in FIG. 23, which assumes that $W_{0F}=C_0Z_{0F}$ and $W_{1F}=C_1Z_{0F}$. We show that by following the reconstruction procedure shown in FIG. 22 the decoder can maintain the second-order statistics of the original signal. The decoder takes a linear combination of the original and filtered versions of W to create a signal S which maintains the second-order statistics of X.

In Example 1, it was determined that the complex constants $C_0$ and $C_1$ can be chosen to match the real portion of the cross-channel second-order statistics by sending two parameters (e.g., left-to-mono (L/M) and right-to-mono (R/M) power ratios). If another parameter is sent by the encoder, then the entire cross-channel second-order statistics of a multi-channel source can be maintained.

For example, the encoder can send an additional, complex parameter that represents the imaginary-to-real ratio of the cross-correlation between the two channels to maintain the entire cross-channel second-order statistics of a two-channel source. Suppose that the correlation matrix is given by $R_{XX}$, as defined in FIG. 24, where U is an orthonormal matrix of complex Eigenvectors, and A is a diagonal matrix of Eigenvalues. Note that this factorization must exist for any symmetric matrix. For any achievable power correlation matrix, the Eigenvalues must also be real. This factorization allows us to find a complex Karhunen-Loeve Transform ("KLT"). A KLT has been used to create de-correlated sources for compression. Here, we wish to do the reverse operation which is take uncorrelated sources and create a desired correlation. The KLT of vector X is given by U*, since $U^*U\Lambda U^*U=\Lambda$, a diagonal matrix. The power in Z is $\alpha$. Therefore if we choose a transform such as $$U\left(\frac{\Lambda}{\alpha}\right)^{1/2}=\begin{bmatrix} aC_0 & bC_0 \\ cC_1 & dC_1 \end{bmatrix},$$

and assume $W_{0F}$ and $W_{1F}$ have the same power as and are uncorrelated to $W_0$ and $W_1$ respectively, the reconstruction procedure in FIG. 23 or 22 produces the desired correlation matrix for the final output. In practice, the encoder sends power ratios $|C_0|$ and $|C_1|$, and the imaginary-to-real ratio $\mathrm{Im}(X_0X_1^*)/\alpha$. The decoder can reconstruct a normalized version of the cross correlation matrix (as shown in FIG. 25). The decoder can then calculate $\theta$ and find Eigenvalues and Eigenvectors, arriving at the desired transform.

Due to the relationship between $|C_0|$ and $|C_1|$, they cannot possess independent values. Hence, the encoder quantizes them jointly or conditionally. This applies to both Examples 1 and 2.

Other parameterizations are also possible, such as by sending from the encoder to the decoder a normalized version of the power matrix directly where we can normalize by the geometric mean of the powers, as shown in FIG. 26. Now the encoder can send just the first row of the matrix, which is sufficient since the product of the diagonals is 1. However, now the decoder scales the Eigenvalues as shown in FIG. 27.

Another parameterization is possible to represent U and $\Lambda$ directly. It can be shown that U can be factorized into a series of Givens rotations. Each Givens rotation can be represented by an angle. The encoder transmits the Givens rotation angles and the Eigenvalues.

Also, both parameterizations can incorporate any additional arbitrary pre-rotation V and still produce the same correlation matrix since $VV^*=I$, where I stands for the identity matrix. That is, the relationship shown in FIG. 28 will work for any arbitrary rotation V. For example, the decoder chooses a pre-rotation such that the amount of filtered signal going into each channel is the same, as represented in FIG. 29. The decoder can choose $\omega$ such that the relationships in FIG. 30 hold.

Once the matrix shown in FIG. 31 is known, the decoder can do the reconstruction as before to obtain the channels $W_0$ and $W_1$. Then the decoder obtains $W_{0F}$ and $W_{1F}$ (the effect signals) by applying a linear filter to $W_0$ and $W_1$. For example, the decoder uses an all-pass filter and can take the output at any of the taps of the filter to obtain the effect signals. (For more information on uses of all-pass filters, see M. R. Schroeder and B. F. Logan, "'Colorless' Artificial Reverberation," 12*th Ann. Meeting of the Audio Eng'g Soc.,* 18 pp. (1960).) The strength of the signal that is added as a post process is given in the matrix shown in FIG. 31.

The all-pass filter can be represented as a cascade of other all-pass filters. Depending on the amount of reverberation needed to accurately model the source, the output from any of the all-pass filters can be taken. This parameter can also be sent on either a band, subframe, or source basis. For example, the output of the first, second, or third stage in the all-pass filter cascade can be taken.

By taking the output of the filter, scaling it and adding it back to the original reconstruction, the decoder is able to maintain the cross-channel second-order statistics. Although the analysis makes certain assumptions on the power and the correlation structure on the effect signal, such assumptions are not always perfectly met in practice. Further processing and better approximation can be used to refine these assumptions. For example, if the filtered signals have a power which is larger than desired, the filtered signal can be scaled as shown in FIG. 32 so that it has the correct power. This ensures that the power is correctly maintained if the power is too large. A calculation for determining whether the power exceeds the threshold is shown in FIG. 33.

There can sometimes be cases when the signal in the two physical channels being combined is out of phase, and thus if sum coding is being used, the matrix will be singular. In such cases, the maximum norm of the matrix can be limited. This parameter (a threshold) to limit the maximum scaling of the matrix can also be sent in the bitstream on a band, subframe, or source basis.

As in Example 1, the analysis in this Example assumes that $B_0=B_1=\beta$. However, the same algebra principles can be used for any transform to obtain similar results.

V. Channel Extension Coding with Other Coding Transforms

The channel extension coding techniques and tools described in Section IV above can be used in combination with other techniques and tools. For example, an encoder can use base coding transforms, frequency extension coding transforms (e.g., extended-band perceptual similarity coding transforms) and channel extension coding transforms. (Frequency extension coding is described in Section V.A., below.) In the encoder, these transforms can be performed in a base coding module, a frequency extension coding module separate from the base coding module, and a channel extension coding module separate from the base coding module and frequency extension coding module. Or, different transforms can be performed in various combinations within the same module.

A. Overview of Frequency Extension Coding

This section is an overview of frequency extension coding techniques and tools used in some encoders and decoders to code higher-frequency spectral data as a function of baseband data in the spectrum (sometimes referred to as extended-band perceptual similarity frequency coding, or wide-sense perceptual similarity coding).

Coding spectral coefficients for transmission in an output bitstream to a decoder can consume a relatively large portion of the available bitrate. Therefore, at low bitrates, an encoder can choose to code a reduced number of coefficients by coding a baseband within the bandwidth of the spectral coefficients and representing coefficients outside the baseband as scaled and shaped versions of the baseband coefficients.

Figure 34:
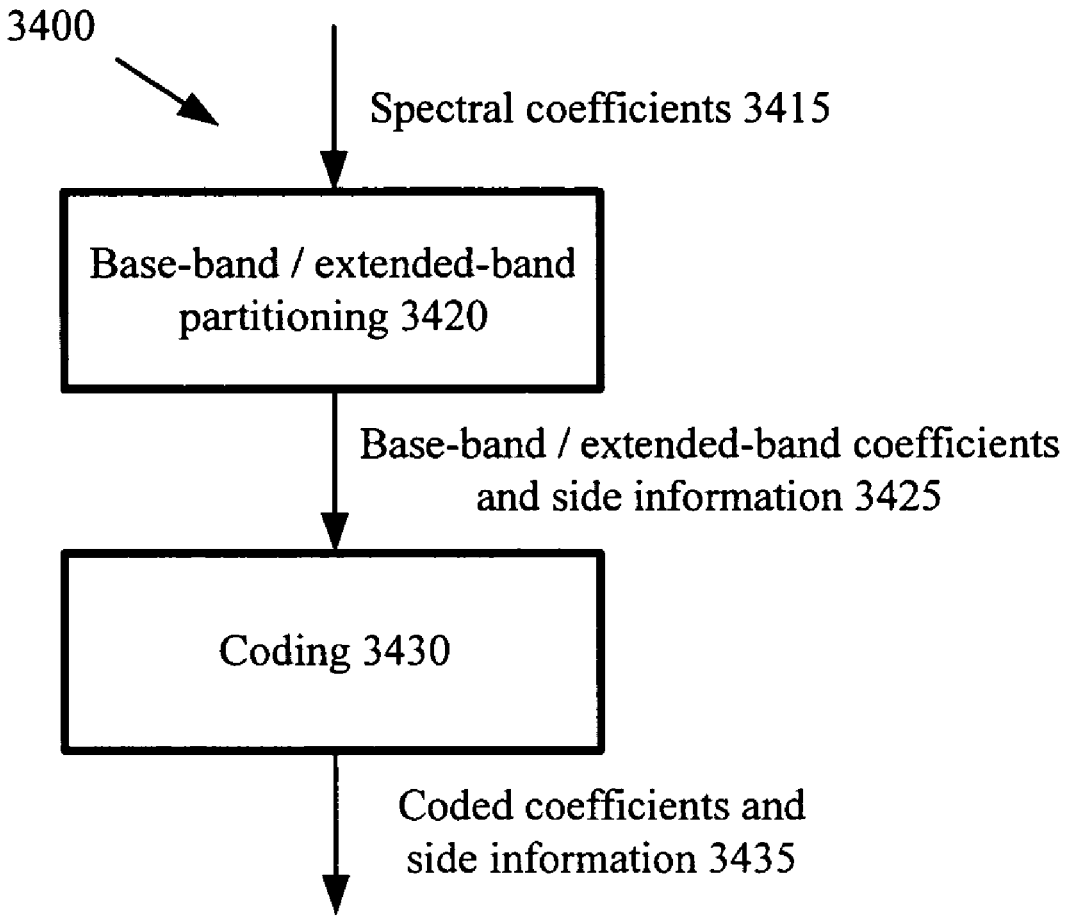
FIG. 34 is a block diagram of aspects of an encoder that performs frequency extension coding.

FIG. 34 illustrates a generalized module 3400 that can be used in an encoder. The illustrated module 3400 receives a set of spectral coefficients 3415. Therefore, at low bitrates, an encoder can choose to code a reduced number of coefficients: a baseband within the bandwidth of the spectral coefficients 3415, typically at the lower end of the spectrum. The spectral coefficients outside the baseband are referred to as "extended-band" spectral coefficients. Partitioning of the baseband and extended band is performed in the baseband/extended-band partitioning section 3420. Sub-band partitioning also can be performed (e.g., for extended-band sub-bands) in this section.

To avoid distortion (e.g., a muffled or low-pass sound) in the reconstructed audio, the extended-band spectral coefficients are represented as shaped noise, shaped versions of other frequency components, or a combination of the two. Extended-band spectral coefficients can be divided into a number of sub-bands (e.g., of 64 or 128 coefficients) which can be disjoint or overlapping. Even though the actual spectrum may be somewhat different, this extended-band coding provides a perceptual effect that is similar to the original.

The baseband/extended-band partitioning section 3420 outputs baseband spectral coefficients 3425, extended-band spectral coefficients, and side information (which can be compressed) describing, for example, baseband width and the individual sizes and number of extended-band sub-bands.

Figure 36:
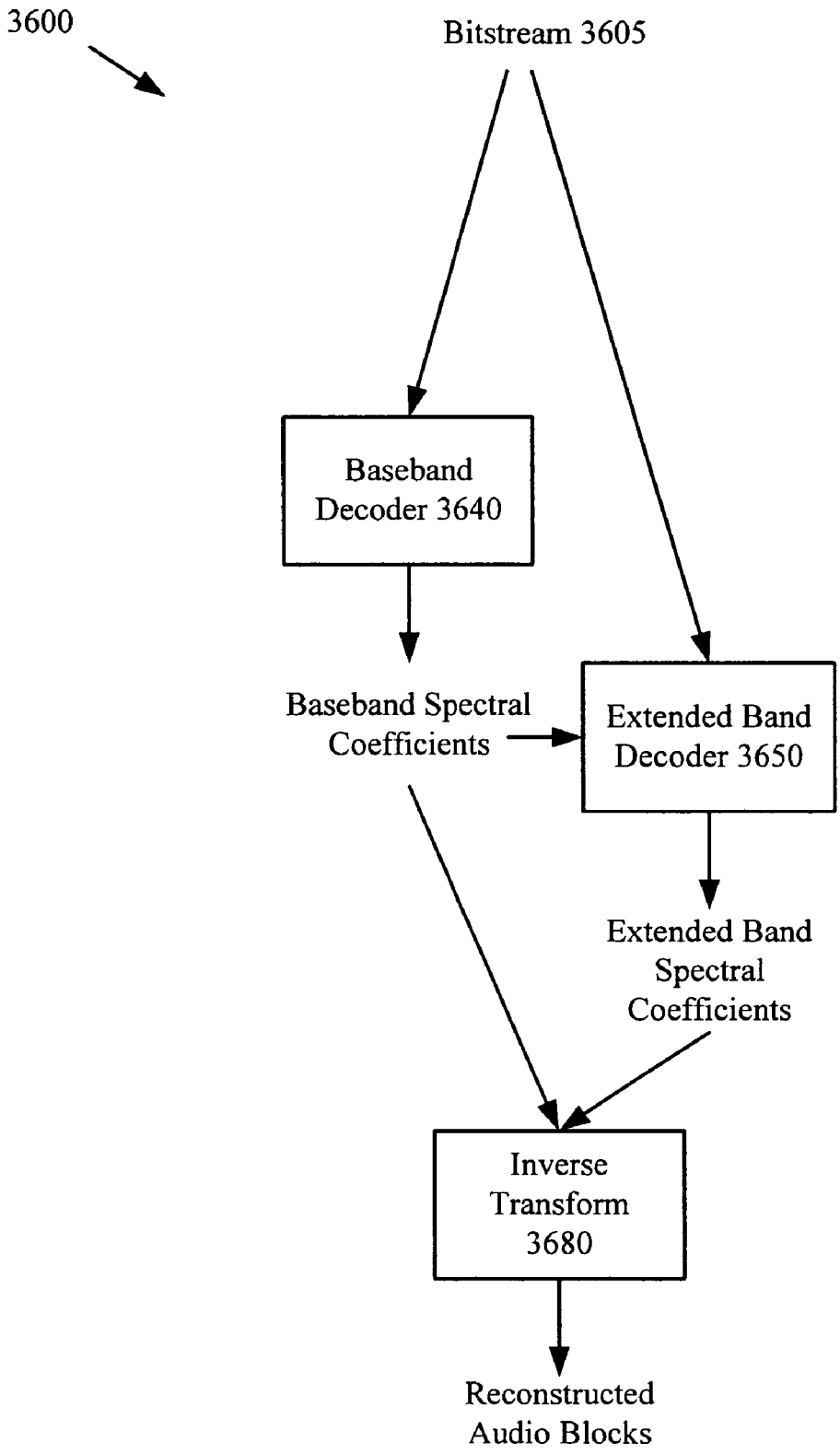
FIG. 36 is a block diagram of aspects of a decoder that performs frequency extension decoding.

In the example shown in FIG. 34, the encoder codes coefficients and side information (3435) in coding module 3430. An encoder may include separate entropy coders for baseband and extended-band spectral coefficients and/or use different entropy coding techniques to code the different categories of coefficients. A corresponding decoder will typically use complementary decoding techniques. (To show another possible implementation, FIG. 36 shows separate decoding modules for baseband and extended-band coefficients.)

An extended-band coder can encode the sub-band using two parameters. One parameter (referred to as a scale parameter) is used to represent the total energy in the band. The other parameter (referred to as a shape parameter) is used to represent the shape of the spectrum within the band.

Figure 35:
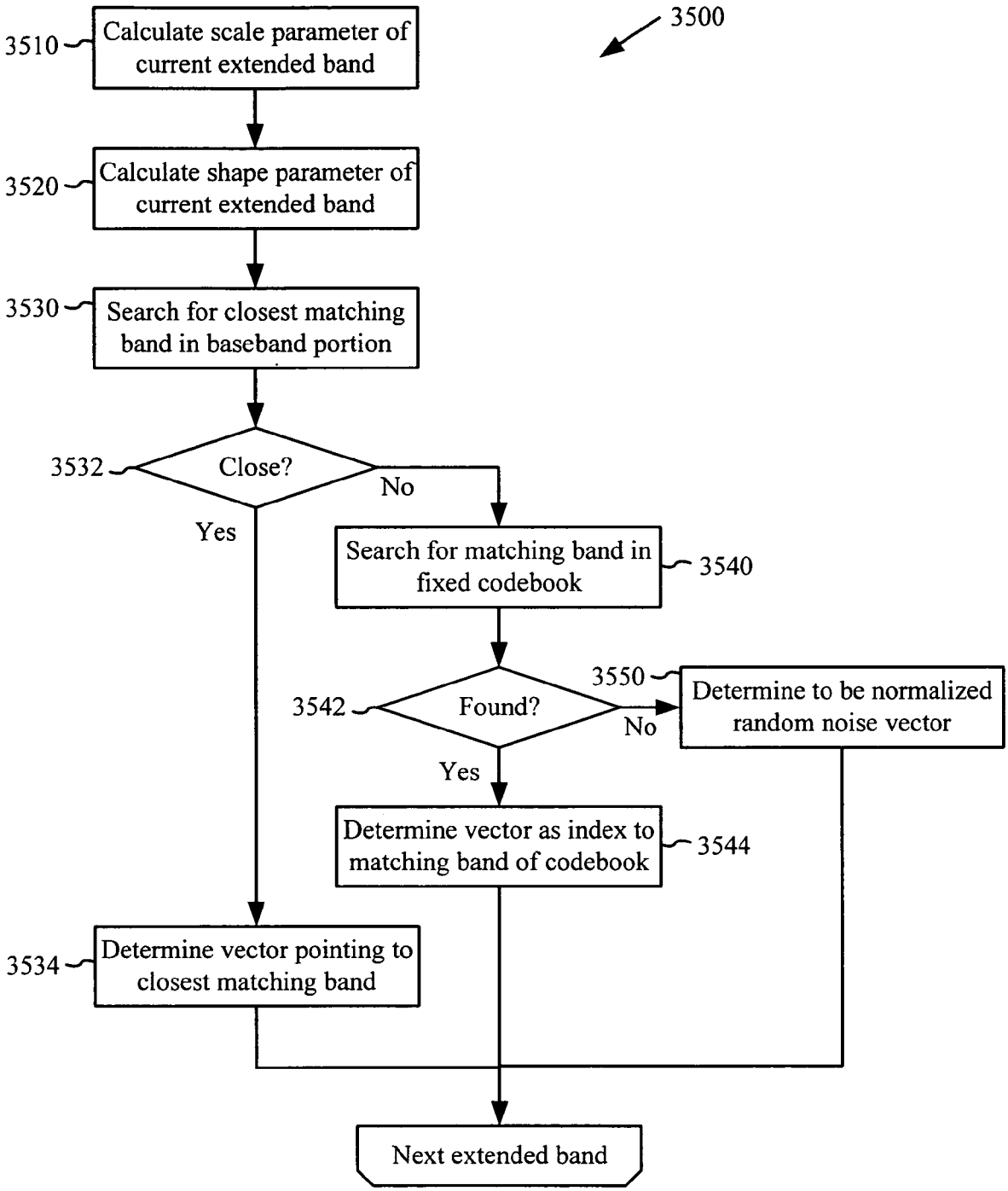
FIG. 35 is a flow chart showing an example technique for encoding extended-band sub-bands.

FIG. 35 shows an example technique 3500 for encoding each sub-band of the extended band in an extended-band coder. The extended-band coder calculates the scale parameter at 3510 and the shape parameter at 3520. Each sub-band coded by the extended-band coder can be represented as a product of a scale parameter and a shape parameter.

For example, the scale parameter can be the root-mean-square value of the coefficients within the current sub-band. This is found by taking the square root of the average squared value of all coefficients. The average squared value is found by taking the sum of the squared value of all the coefficients in the sub-band, and dividing by the number of coefficients.

The shape parameter can be a displacement vector that specifies a normalized version of a portion of the spectrum that has already been coded (e.g., a portion of baseband spectral coefficients coded with a baseband coder), a normalized random noise vector, or a vector for a spectral shape from a fixed codebook. A displacement vector that specifies another portion of the spectrum is useful in audio since there are typically harmonic components in tonal signals which repeat throughout the spectrum. The use of noise or some other fixed codebook can facilitate low bitrate coding of components which are not well-represented in a baseband-coded portion of the spectrum.

Some encoders allow modification of vectors to better represent spectral data. Some possible modifications include a linear or non-linear transform of the vector, or representing the vector as a combination of two or more other original or modified vectors. In the case of a combination of vectors, the modification can involve taking one or more portions of one vector and combining it with one or more portions of other vectors. When using vector modification, bits are sent to inform a decoder as to how to form a new vector. Despite the additional bits, the modification consumes fewer bits to represent spectral data than actual waveform coding.

The extended-band coder need not code a separate scale factor per sub-band of the extended band. Instead, the extended-band coder can represent the scale parameter for the sub-bands as a function of frequency, such as by coding a set of coefficients of a polynomial function that yields the scale parameters of the extended sub-bands as a function of their frequency. Further, the extended-band coder can code additional values characterizing the shape for an extended sub-band. For example, the extended-band coder can encode values to specify shifting or stretching of the portion of the baseband indicated by the motion vector. In such a case, the shape parameter is coded as a set of values (e.g., specifying position, shift, and/or stretch) to better represent the shape of the extended sub-band with respect to a vector from the coded baseband, fixed codebook, or random noise vector.

The scale and shape parameters that code each sub-band of the extended band both can be vectors. For example, the extended sub-bands can be represented as a vector product scale(f)·shape(f) in the time domain of a filter with frequency response scale(f) and an excitation with frequency response shape(f). This coding can be in the form of a linear predictive coding (LPC) filter and an excitation. The LPC filter is a low-order representation of the scale and shape of the extended sub-band, and the excitation represents pitch and/or noise characteristics of the extended sub-band. The excitation can come from analyzing the baseband-coded portion of the spectrum and identifying a portion of the baseband-coded spectrum, a fixed codebook spectrum or random noise that matches the excitation being coded. This represents the extended sub-band as a portion of the baseband-coded spectrum, but the matching is done in the time domain.

Referring again to FIG. 35, at 3530 the extended-band coder searches baseband spectral coefficients for a like band out of the baseband spectral coefficients having a similar shape as the current sub-band of the extended band (e.g., using a least-mean-square comparison to a normalized version of each portion of the baseband). At 3532, the extended-band coder checks whether this similar band out of the baseband spectral coefficients is sufficiently close in shape to the current extended band (e.g., the least-mean-square value is lower than a pre-selected threshold). If so, the extended-band coder determines a vector pointing to this similar band of baseband spectral coefficients at 3534. The vector can be the starting coefficient position in the baseband. Other methods (such as checking tonality vs. non-tonality) also can be used to see if the similar band of baseband spectral coefficients is sufficiently close in shape to the current extended band.

If no sufficiently similar portion of the baseband is found, the extended-band coder then looks to a fixed codebook (3540) of spectral shapes to represent the current sub-band. If found (3542), the extended-band coder uses its index in the code book as the shape parameter at 3544. Otherwise, at 3550, the extended-band coder represents the shape of the current sub-band as a normalized random noise vector.

Alternatively, the extended-band coder can decide how spectral coefficients can be represented with some other decision process.

The extended-band coder can compress scale and shape parameters (e.g., using predictive coding, quantization and/or entropy coding). For example, the scale parameter can be predictively coded based on a preceding extended sub-band. For multi-channel audio, scaling parameters for sub-bands can be predicted from a preceding sub-band in the channel. Scale parameters also can be predicted across channels, from more than one other sub-band, from the baseband spectrum, or from previous audio input blocks, among other variations. The prediction choice can be made by looking at which previous band (e.g., within the same extended band, channel or tile (input block)) provides higher correlations. The extended-band coder can quantize scale parameters using uniform or non-uniform quantization, and the resulting quantized value can be entropy coded. The extended-band coder also can use predictive coding (e.g., from a preceding sub-band), quantization, and entropy coding for shape parameters.

If sub-band sizes are variable for a given implementation, this provides the opportunity to size sub-bands to improve coding efficiency. Often, sub-bands which have similar characteristics may be merged with very little effect on quality. Sub-bands with highly variable data may be better represented if a sub-band is split. However, smaller sub-bands require more sub-bands (and, typically, more bits) to represent the same spectral data than larger sub-bands. To balance these interests, an encoder can make sub-band decisions based on quality measurements and bitrate information.

A decoder de-multiplexes a bitstream with baseband/extended-band partitioning and decodes the bands (e.g., in a baseband decoder and an extended-band decoder) using corresponding decoding techniques. The decoder may also perform additional functions.

FIG. 36 shows aspects of an audio decoder 3600 for decoding a bitstream produced by an encoder that uses frequency extension coding and separate encoding modules for baseband data and extended-band data. In FIG. 36, baseband data and extended-band data in the encoded bitstream 3605 is decoded in baseband decoder 3640 and extended-band decoder 3650, respectively. The baseband decoder 3640 decodes the baseband spectral coefficients using conventional decoding of the baseband codec. The extended-band decoder FF 50 decodes the extended-band data, including by copying over portions of the baseband spectral coefficients pointed to by the motion vector of the shape parameter and scaling by the scaling factor of the scale parameter. The baseband and extended-band spectral coefficients are combined into a single spectrum, which is converted by inverse transform 3680 to reconstruct the audio signal.

Section IV described techniques for representing all frequencies in a non-coded channel using a scaled version of the spectrum from one or more coded channels. Frequency extension coding differs in that extended-band coefficients are represented using scaled versions of the baseband coefficients. However, these techniques can be used together, such as by performing frequency extension coding on a combined channel and in other ways as described below.

B. Examples of Channel Extension Coding with Other Coding Transforms

Figure 37:
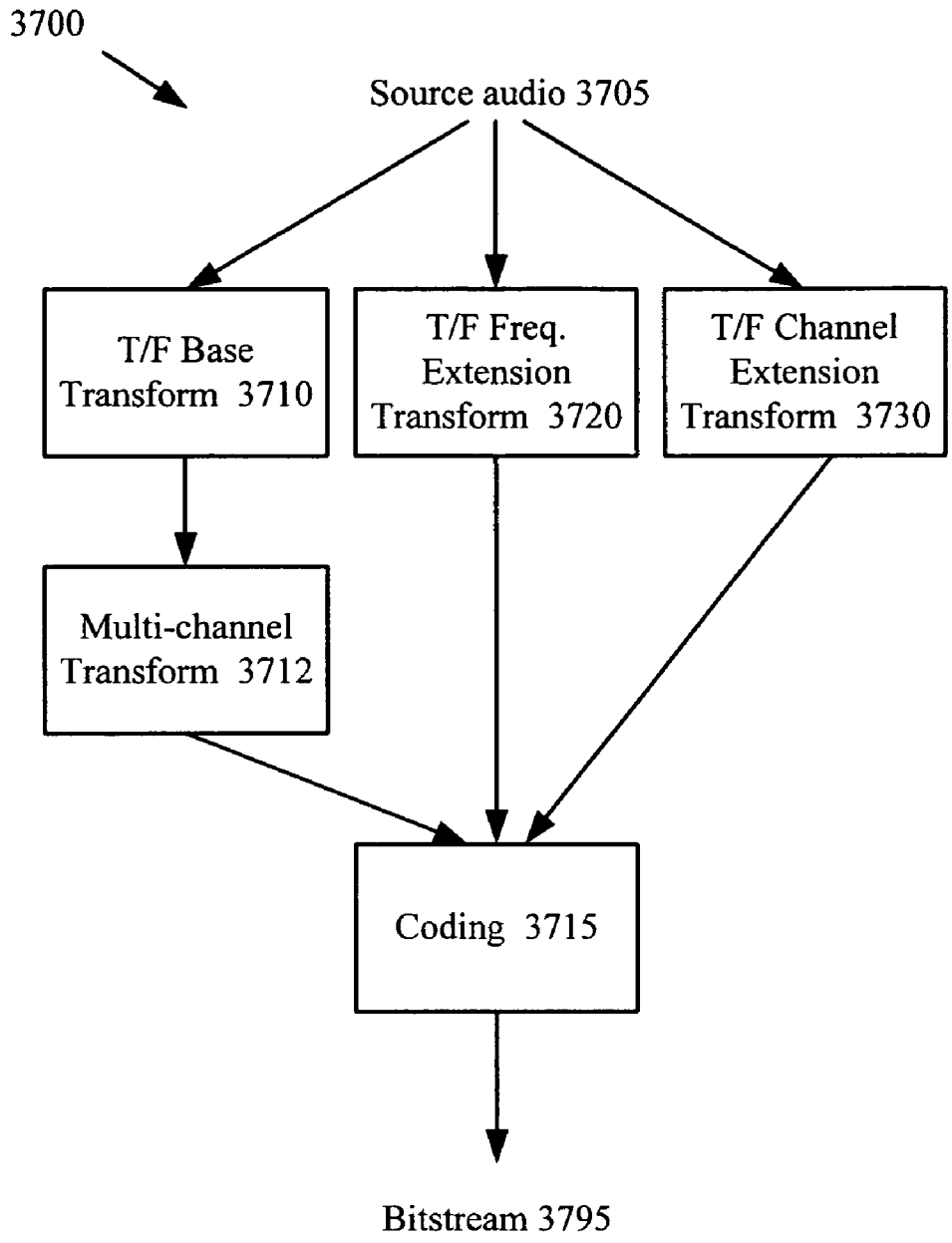
FIG. 37 is a block diagram of aspects of an encoder that performs channel extension coding and frequency extension coding.

FIG. 37 is a diagram showing aspects of an example encoder 3700 that uses a time-to-frequency (T/F) base transform 3710, a T/F frequency extension transform 3720, and a T/F channel extension transform 3730 to process multi-channel source audio 3705. (Other encoders may use different combinations or other transforms in addition to those shown.)

The T/F transform can be different for each of the three transforms.

For the base transform, after a multi-channel transform 3712, coding 3715 comprises coding of spectral coefficients. If channel extension coding is also being used, at least some frequency ranges for at least some of the multi-channel transform coded channels do not need to be coded. If frequency extension coding is also being used, at least some frequency ranges do not need to be coded. For the frequency extension transform, coding 3715 comprises coding of scale and shape parameters for bands in a subframe. If channel extension coding is also being used, then these parameters may not need to be sent for some frequency ranges for some of the channels. For the channel extension transform, coding 3715 comprises coding of parameters (e.g., power ratios and a complex parameter) to accurately maintain cross-channel correlation for bands in a subframe. For simplicity, coding is shown as being formed in a single coding module 3715. However, different coding tasks can be performed in different coding modules.

Figure 38:
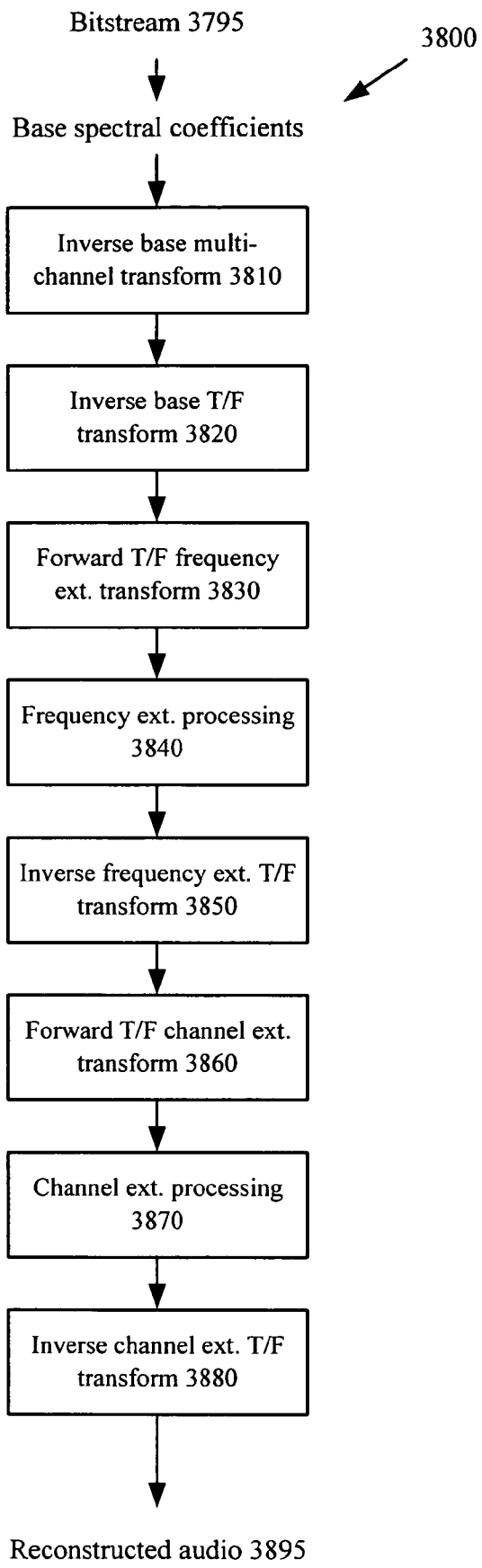
FIGS. 38, 39 and 40 are block diagrams of aspects of decoders that perform channel extension decoding and frequency extension decoding.
Figure 39:
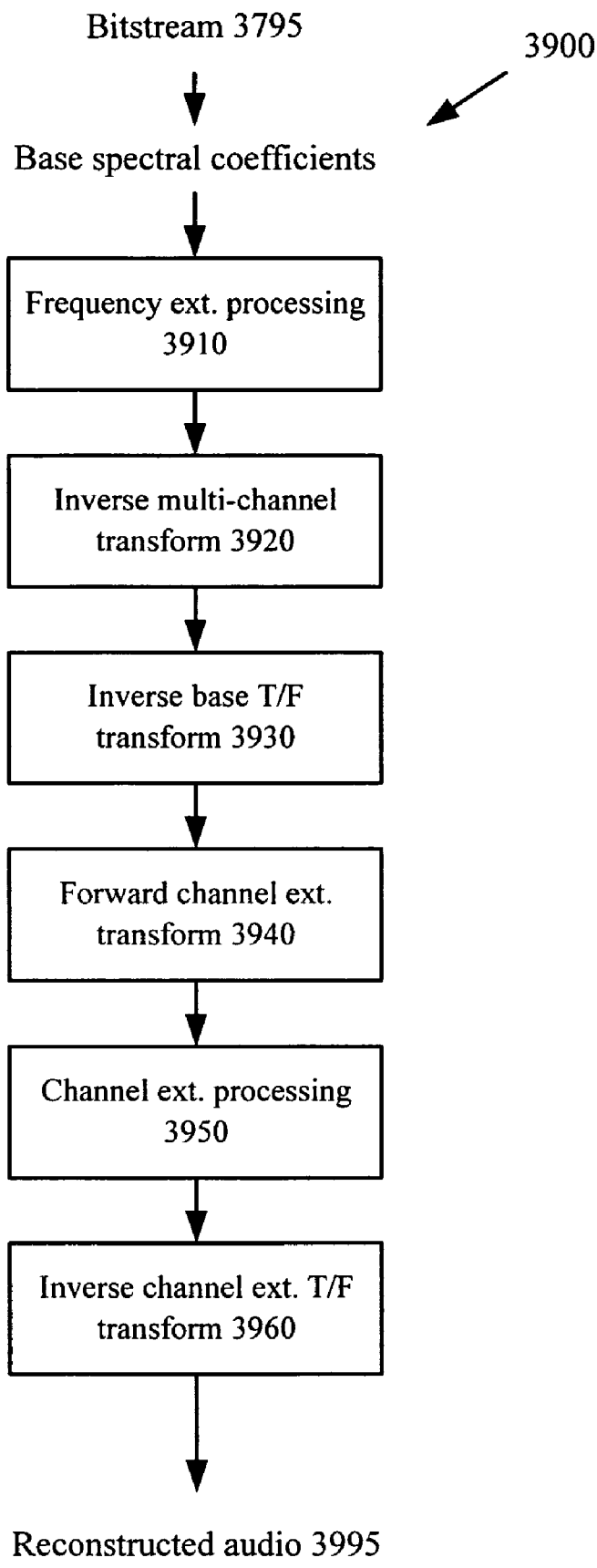
Figure 40:
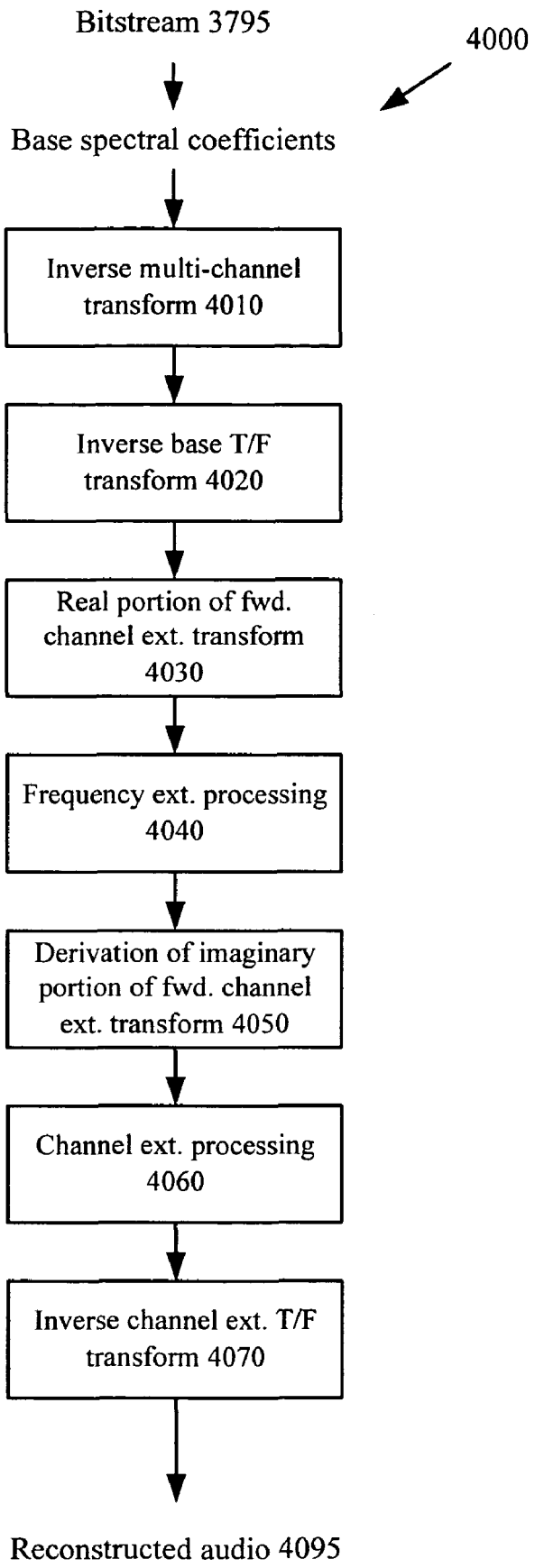

FIGS. 38, 39 and 40 are diagrams showing aspects of decoders 3800, 3900 and 4000 that decode a bitstream such as bitstream 3795 produced by example encoder 3700. In the decoders, 3800, 3900 and 4000, some modules (e.g., entropy decoding, inverse quantization/weighting, additional post-processing) that are present in some decoders are not shown for simplicity. Also, the modules shown may in some cases be rearranged, combined, or divided in different ways. For example, although single paths are shown, the processing paths may be divided conceptually into two or more processing paths.

In decoder 3800, base spectral coefficients are processed with an inverse base multi-channel transform 3810, inverse base T/F transform 3820, forward T/F frequency extension transform 3830, frequency extension processing 3840, inverse frequency extension T/F transform 3850, forward T/F channel extension transform 3860, channel extension processing 3870, and inverse channel extension T/F transform 3880 to produce reconstructed audio 3895.

However, for practical purposes, this decoder may be undesirably complicated. Also, the channel extension transform is complex, while the other two are not. Therefore, other decoders can be adjusted in the following ways: the T/F transform for frequency extension coding can be limited to (1) base T/F transform, or (2) the real portion of the channel extension T/F transform.

This allows configurations such as those shown in FIGS. 39 and 40.

In FIG. 39, decoder 3900 processes base spectral coefficients with frequency extension processing 3910, inverse multi-channel transform 3920, inverse base T/F transform 3930, forward channel extension transform 3940, channel extension processing 3950, and inverse channel extension T/F transform 3960 to produce reconstructed audio 3995.

In FIG. 40, decoder 4000 processes base spectral coefficients with inverse multi-channel transform 4010, inverse base T/F transform 4020, real portion of forward channel extension transform 4030, frequency extension processing 4040, derivation of the imaginary portion of forward channel extension transform 4050, channel extension processing 4060, and inverse channel extension T/F transform 4070 to produce reconstructed audio 4095.

Any of these configurations can be used, and a decoder can dynamically change which configuration is being used. In one implementation, the transform used for the base and frequency extension coding is the MLT (which is the real portion of the MCLT (modulated complex lapped transform) and the transform used for the channel extension transform is the MCLT. However, the two have different subframe sizes.

Each MCLT coefficient in a subframe has a basis function which spans that subframe. Since each subframe only overlaps with the neighboring two subframes, only the MLT coefficients from the current subframe, previous subframe, and next subframe are needed to find the exact MCLT coefficients for a given subframe.

The transforms can use same-size transform blocks, or the transform blocks may be different sizes for the different kinds of transforms. Different size transforms blocks in the base coding transform and the frequency extension coding transform can be desirable, such as when the frequency extension coding transform can improve quality by acting on smaller-time-window blocks. However, changing transform sizes at base coding, frequency extension coding and channel coding introduces significant complexity in the encoder and in the decoder. Thus, sharing transform sizes between at least some of the transform types can be desirable.

As an example, if the base coding transform and the frequency extension coding transform share the same transform block size, the channel extension coding transform can have a transform block size independent of the base coding/frequency extension coding transform block size. In this example, the decoder can comprise frequency reconstruction followed by an inverse base coding transform. Then, the decoder performs a forward complex transform to derive spectral coefficients for scaling the coded, combined channel. The complex channel coding transform uses its own transform block size, independent of the other two transforms. The decoder reconstructs the physical channels in the frequency domain from the coded, combined channel (e.g., a sum channel) using the derived spectral coefficients, and performs an inverse complex transform to obtain time-domain samples from the reconstructed physical channels.

As another example, if the if the base coding transform and the frequency extension coding transform have different transform block sizes, the channel coding transform can have the same transform block size as the frequency extension coding transform block size. In this example, the decoder can comprise an inverse base coding transform followed by frequency reconstruction. The decoder performs an inverse channel transform using the same transform block size as was used for the frequency reconstruction. Then, the decoder performs a forward transform of the complex component to derive the spectral coefficients.

In the forward transform, the decoder can compute the imaginary portion of MCLT coefficients of the channel extension transform coefficients from the real portion. For example, the decoder can calculate an imaginary portion in a current block by looking at real real portions from some bands (e.g., three bands or more) from a previous block, some bands (e.g., two bands) from the current block, and some bands (e.g., three bands or more) from the next block.

The mapping of the real portion to an imaginary portion involves taking a dot product between the inverse modulated DCT basis with the forward modulated discrete sine transform (DST) basis vector. Calculating the imaginary portion for a given subframe involves finding all the DST coefficients within a subframe. This can only be non-0 for DCT basis vectors from the previous subframe, current subframe, and next subframe. Furthermore, only DCT basis vectors of approximately similar frequency as the DST coefficient that we are trying to find have significant energy. If the subframe sizes for the previous, current, and next subframe are all the same, then the energy drops off significantly for frequencies different than the one we are trying to find the DST coefficient for. Therefore, a low complexity solution can be found for finding the DST coefficients for a given subframe given the DCT coefficients.

Specifically, we can compute $Xs=A*Xc(-1)+B*Xc(0)+C*Xc(1)$ where $Xc(-1)$, $Xc(0)$ and $Xc(1)$ stand for the DCT coefficients from the previous, current and the next block and Xs represent the DST coefficients of the current block:

1) Pre-compute A, B and C matrix for different window shape/size
2) Threshold A, B, and C matrix so values significantly smaller than the peak values are reduced to 0, reducing them to sparse matrixes
3) Compute the matrix multiplication only using the non-zero matrix elements.

In applications where complex filter banks are needed, this is a fast way to derive the imaginary from the real portion, or vice versa, without directly computing the imaginary portion.

The decoder reconstructs the physical channels in the frequency domain from the coded, combined channel (e.g., a sum channel) using the derived scale factors, and performs an inverse complex transform to obtain time-domain samples from the reconstructed physical channels.

The approach results in significant reduction in complexity compared to the brute force approach which involves an inverse DCT and a forward DST.

C. Reduction of Computational Complexity in Frequency/Channel Coding

The frequency/channel coding can be done with base coding transforms, frequency coding transforms, and channel coding transforms. Switching transforms from one to another on block or frame basis can improve perceptual quality, but it is computationally expensive. In some scenarios (e.g., low-processing-power devices), such high complexity may not be acceptable. One solution for reducing the complexity is to force the encoder to always select the base coding transforms for both frequency and channel coding. However, this approach puts a limitation on the quality even for playback devices that are without power constraints. Another solution is to let the encoder perform without transform constraints and have the decoder map frequency/channel coding parameters to the base coding transform domain if low complexity is required. If the mapping is done in a proper way, the second solution can achieve good quality for high-power devices and good quality for low-power devices with reasonable complexity. The mapping of the parameters to the base transform domain from the other domains can be performed with no extra information from the bitstream, or with additional information put into the bitstream by the encoder to improve the mapping performance.

D. Improving Energy Tracking of Frequency Coding in Transition Between Different Window Sizes As indicated in Section V.B, an frequency coding encoder can use base coding transforms, frequency coding transforms (e.g., extended-band perceptual similarity coding transforms) and channel coding transforms. However, when the frequency encoding is switching between two different transforms, the starting point of the frequency encoding may need extra attention. This is because the signal in one of the transforms, such as the base transform, is usually bandpassed, with a clear-pass band defined by the last coded coefficient. However, such a clear boundary, when mapped to a different transform, can become fuzzy. In one implementation, the frequency encoder makes sure no signal power is lost by carefully defining the starting point. Specifically, 1) For each band, the frequency encoder computes the energy of the previously (by base coding eg) compressed signal—E1.
2) For each band, the frequency encoder computes the energy of the original signal—E2.
3) If (E2−E1)>T, where T is a predefined threshold, the frequency encoder marks this band as the starting point.
4) The frequency encoder starts the operation here, and
5) The frequency encoder transmits the starting point to the decoder.

In this way, a frequency encoder, when switching between different transforms, detects the energy difference and transmits a starting point accordingly.

VI. Shape and Scale Parameters for Frequency Extension Coding

A. Displacement Vectors for Encoders Using Modulated DCT Coding

As mentioned in Section V above, extended-band perceptual similarity frequency coding involves determining shape parameters and scale parameters for frequency bands within time windows. Shape parameters specify a portion of a baseband (typically a lower band) that will act as the basis for coding coefficients in an extended band (typically a higher band than the baseband). For example, coefficients in the specified portion of the baseband can be scaled and then applied to the extended band.

Figure 41:
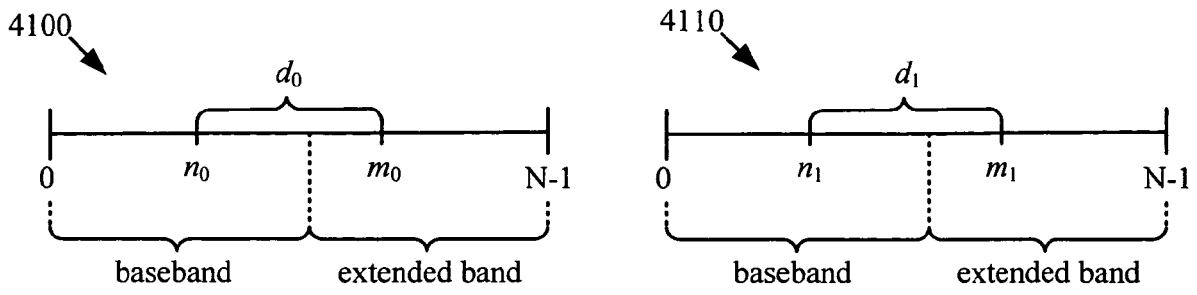
FIG. 41 is a diagram that shows representations of displacement vectors for two audio blocks.

A displacement vector d can be used to modulate the signal of a channel at time t, as shown in FIG. 41. FIG. 41 shows representations of displacement vectors for two audio blocks 4100 and 4110 at time $t_0$ and $t_1$, respectively. Although the example shown in FIG. 41 involves frequency extension coding concepts, this principle can be applied to other modulation schemes that are not related to frequency extension coding.

In the example shown in FIG. 41, audio blocks 4100 and 4110 comprise N sub-bands in the range 0 to N−1, with the sub-bands in each block partitioned into a lower-frequency baseband and a higher-frequency extended band. For audio block 4100, the displacement vector $d_0$ is shown to be the displacement between sub-bands $m_0$ and $n_0$. Similarly, for audio block 4110, the displacement vector $d_1$ is shown to be the displacement between sub-bands $m_1$ and $n_1$ Since the displacement vector is meant to accurately describe the shape of extended-band coefficients, one might assume that allowing maximum flexibility in the displacement vector would be desirable. However, restricting values of displacement vectors in some situations leads to improved perceptual quality. For example, an encoder can choose sub-bands m and n such that they are each always even or odd-numbered sub-bands, making the number of sub-bands covered by the displacement vector d always even. In an encoder that uses modulated discrete cosine transforms (DCT), when the number of sub-bands covered by the displacement vector d is even, better reconstruction is possible.

When extended-band perceptual similarity frequency coding is performed using modulated DCTs, a cosine wave from the baseband is modulated to produce a modulated cosine wave for the extended band. If the number of sub-bands covered by the displacement vector d is even, the modulation leads to accurate reconstruction. However, if the number of sub-bands covered by the displacement vector d is odd, the modulation leads to distortion in the reconstructed audio. Thus, by restricting displacement vectors to cover only even numbers of sub-bands (and sacrificing some flexibility in d), better overall sound quality can be achieved by avoiding distortion in the modulated signal. Thus, in the example shown in FIG. 41, the displacement vectors in audio blocks 4100 and 4110 each cover an even number of sub-bands.

B. Anchor Points for Scale Parameters

When frequency coding has smaller windows than the base coder, bitrate tends to increase. This is because while the windows are smaller, it is still important to keep frequency resolution at a fairly high level to avoid unpleasant artifacts.

Figure 42:
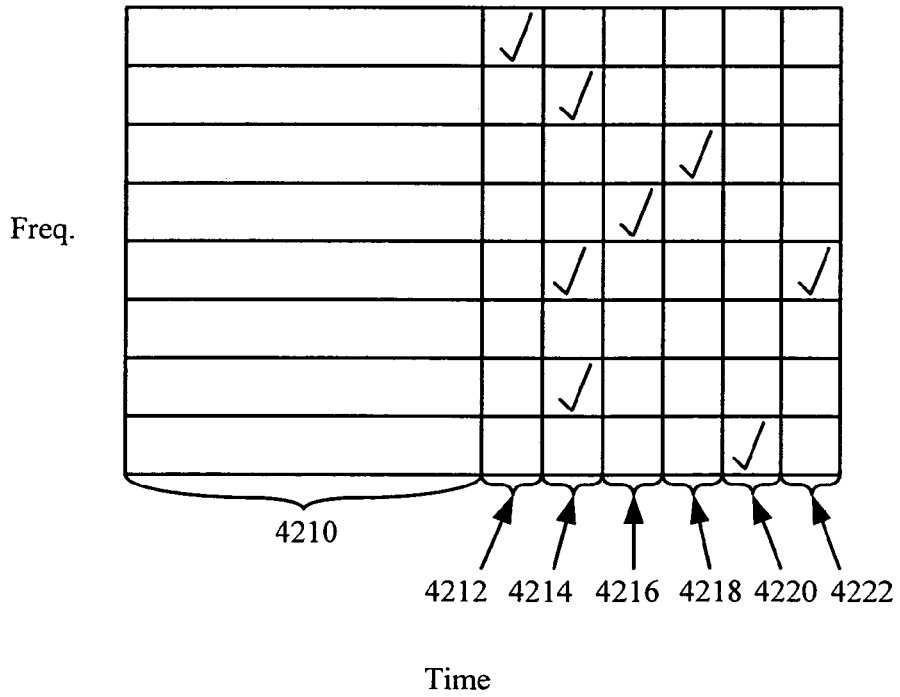
FIG. 42 is a diagram that shows an arrangement of audio blocks having anchor points for interpolation of scale parameters.

FIG. 42 shows a simplified arrangement of audio blocks of different sizes. Time window 4210 has a longer duration than time windows 4212-4222, but each time window has the same number of frequency bands.

The check-marks in FIG. 42 indicate anchor points for each frequency band. As shown in FIG. 42, the numbers of anchor points can vary between bands, as can the temporal distances between anchor points. (For simplicity, not all windows, bands or anchor points are shown in FIG. 42.) At these anchor points, scale parameters are determined. Scale parameters for the same bands in other time windows can then be interpolated from the parameters at the anchor points.

Alternatively, anchor points can be determined in other ways.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. In an audio decoder, a computer-implemented method of decoding encoded multi-channel audio data, the method comprising:

receiving channel extension coding data comprising:

a combined audio channel;

plural power ratios representing power of individual audio channels relative to the combined audio channel; and a complex parameter representing an imaginary-to-real ratio of cross-correlation between the individual audio channels;

receiving frequency extension coding data comprising scale and shape parameters for representing extended-band coefficients as scaled versions of baseband coefficients; and reconstructing the individual audio channels using the channel extension coding data and the frequency extension coding data;

wherein the reconstructing comprises performing a real portion of a forward channel extension transform followed by frequency extension processing, and wherein the reconstructing further comprises deriving an imaginary portion of the forward channel extension transform after the frequency extension processing.

2. The method of claim 1 wherein the scale and shape parameters for representing extended-band coefficients are omitted for one or more frequency ranges in one or more of the individual audio channels.

3. The method of claim 1 wherein the combined channel is a sum channel.

4. The method of claim 1 wherein the combined channel is a difference channel.

5. The method of claim 1 wherein the forward channel extension transform is a modulated complex lapped transform comprising the real portion and an imaginary portion.

6. The method of claim 1 wherein the reconstructing comprises:

using a non-complex transform as a frequency extension transform.

7. In an audio decoder, a computer-implemented method of decoding encoded multi-channel audio data, the method comprising:

receiving channel extension coding data comprising:

a combined audio channel;

plural power ratios representing power of individual audio channels relative to the combined audio channel; and a complex parameter representing an imaginary-to-real ratio of cross-correlation between the individual audio channels;

receiving frequency extension coding data comprising scale and shape parameters for representing extended-band coefficients as scaled versions of baseband coefficients; and reconstructing the individual audio channels using the channel extension coding data and the frequency extension coding data;

wherein the reconstructing comprises performing a real portion of a forward channel extension transform followed by frequency extension processing, wherein the forward channel extension transform is a modulated complex lapped transform comprising the real portion and an imaginary portion, and wherein the real portion is used for frequency extension coding.

8. The method of claim 7 wherein the reconstructing comprises:

using a non-complex transform as a frequency extension transform.

9. The method of claim 7 wherein the scale and shape parameters for representing extended-band coefficients are omitted for one or more frequency ranges in one or more of the individual audio channels.

10. The method of claim 7 wherein the combined channel is a sum channel.

11. The method of claim 7 wherein the combined channel is a difference channel.

12. One or more tangible computer-readable media storing computer-executable instructions for causing a computer programmed thereby to perform a method of decoding encoded multi-channel audio data, the method comprising:

receiving channel extension coding data comprising:

a combined audio channel;

plural power ratios representing power of individual audio channels relative to the combined audio channel; and a complex parameter representing an imaginary-to-real ratio of cross-correlation between the individual audio channels;

receiving frequency extension coding data comprising scale and shape parameters for representing extended-band coefficients as scaled versions of baseband coefficients; and reconstructing the individual audio channels using the channel extension coding data and the frequency extension coding data;

wherein the reconstructing comprises performing a real portion of a forward channel extension transform followed by frequency extension processing, and wherein the reconstructing further comprises deriving an imaginary portion of the forward channel extension transform after the frequency extension processing.

13. The computer-readable media of claim 12 wherein the scale and shape parameters for representing extended-band coefficients are omitted for one or more frequency ranges in one or more of the individual audio channels.

14. The computer-readable media of claim 12 wherein the combined channel is a sum channel.

15. The computer-readable media of claim 12 wherein the combined channel is a difference channel.

16. The computer-readable media of claim 12 wherein the reconstructing comprises:

using a non-complex transform as a frequency extension transform.

17. The method of claim 12 wherein the forward channel extension transform is a modulated complex lapped transform comprising the real portion and an imaginary portion.

18. One or more tangible computer-readable media storing computer-executable instructions for causing a computer programmed thereby to perform a method of decoding encoded multi-channel audio data, the method comprising:

receiving channel extension coding data comprising:

a combined audio channel;

plural power ratios representing power of individual audio channels relative to the combined audio channel; and a complex parameter representing an imaginary-to-real ratio of cross-correlation between the individual audio channels;

receiving frequency extension coding data comprising scale and shape parameters for representing extended-band coefficients as scaled versions of baseband coefficients; and reconstructing the individual audio channels using the channel extension coding data and the frequency extension coding data;

wherein the reconstructing comprises performing a real portion of a forward channel extension transform followed by frequency extension processing, wherein the forward channel extension transform is a modulated complex lapped transform comprising the real portion and an imaginary portion, and wherein the real portion is used for frequency extension coding.

19. The computer-readable media of claim 18 wherein the scale and shape parameters for representing extended-band coefficients are omitted for one or more frequency ranges in one or more of the individual audio channels.

20. The computer-readable media of claim 18 wherein the combined channel is a sum channel.

21. The computer-readable media of claim 18 wherein the combined channel is a difference channel.

22. The computer-readable media of claim 18 wherein the reconstructing comprises:

using a non-complex transform as a frequency extension transform.

* * * * *